US008185027B2

(12) United States Patent
Nieda

(10) Patent No.: US 8,185,027 B2
(45) Date of Patent: May 22, 2012

(54) IMAGE FORMING APPARATUS, METHOD OF ALLOWING DRIVEN MEMBER TO BE MOUNTED ON APPARATUS BODY IN IMAGE FORMING APPARATUS AND METHOD OF ALLOWING DRIVE FORCE TO BE TRANSMITTED TO BELT UNIT IN IMAGE FORMING APPARATUS

(75) Inventor: Hiroaki Nieda, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/243,260

(22) Filed: Sep. 23, 2011

(65) Prior Publication Data

US 2012/0014715 A1 Jan. 19, 2012

Related U.S. Application Data

(62) Division of application No. 12/251,979, filed on Oct. 15, 2008, now Pat. No. 8,045,889.

(30) Foreign Application Priority Data

Mar. 26, 2008 (JP) ..... 2008-081254

(51) Int. Cl.
*G03G 15/01* (2006.01)

(52) U.S. Cl. ..... 399/299; 399/82; 399/167; 399/302

(58) Field of Classification Search ..... 399/299, 399/302, 167, 82
See application file for complete search history.

(56) References Cited

U.S. PATENT DOCUMENTS

| | | | | |
|---|---|---|---|---|
| 7,995,951 | B2 * | 8/2011 | Nieda | 399/167 |
| 2006/0146371 | A1 | 7/2006 | Hoashi et al. | 358/401 |
| 2007/0116497 | A1 * | 5/2007 | Yamazaki | 399/299 |

FOREIGN PATENT DOCUMENTS

| | | |
|---|---|---|
| JP | 7-181773 | 7/1995 |
| JP | 8-328449 | 12/1996 |
| JP | 2001-134029 | 5/2001 |
| JP | 2002-149037 | 5/2002 |
| JP | 2005-157112 | 6/2005 |
| JP | 2005-164718 | 6/2005 |

* cited by examiner

*Primary Examiner* — Sophia S Chen
(74) *Attorney, Agent, or Firm* — Morgan, Lewis & Bockius LLP

(57) ABSTRACT

The image forming apparatus includes: an apparatus body including a drive source; a driven member detachably attachable to the apparatus body; a first transmission member in the apparatus body, including a base rotatable around a rotation axis, and transmitting drive force from the drive source to the driven member; and a second transmission member in the driven member, including a base rotatable around the rotation axis, and transmitting drive force from the first transmission member to the driven member. Any of the first and second transmission members includes a projection, and the other includes a receiving port. The receiving port receives the projection when a rotation angle between the first and second transmission members is an angle set in advance while not receiving the projection when the rotation angle is out of the angle, at the time of mounting the driven member on the apparatus body.

13 Claims, 15 Drawing Sheets

IMAGE FORMING APPARATUS, METHOD OF ALLOWING DRIVEN MEMBER TO BE MOUNTED ON APPARATUS BODY IN IMAGE FORMING APPARATUS AND METHOD OF ALLOWING DRIVE FORCE TO BE TRANSMITTED TO BELT UNIT IN IMAGE FORMING APPARATUS

This application is a Divisional of U.S. patent application Ser. No. 12/251,979 filed on Oct. 15, 2008 now U.S. Pat. No. 8,045,889 and claims priority to Japanese Patent Application No. 2008-081254 filed Mar. 26, 2008, both of which are hereby incorporated by reference in their entirety.

BACKGROUND OF THE INVENTION

1. Field of the Invention

The present invention relates to an image forming apparatus, a method of allowing a driven member to be mounted on an apparatus body in an image forming apparatus and a method of allowing drive force to be transmitted to a belt unit in an image forming apparatus.

2. Related Art

If a photoconductor drum that is not used in image formation is rotated, abrasion of the photoconductor drum by a cleaning blade and the like are accelerated.

SUMMARY OF THE INVENTION

According to an aspect of the present invention, there is provided an image forming apparatus including: an apparatus body that includes a drive source; a driven member that is detachably attachable to the apparatus body; a first transmission member that is provided in the apparatus body, that includes a base rotatable around a rotation axis, and that transmits drive force from the drive source to the driven member; and a second transmission member that is provided in the driven member, that includes a base rotatable around the rotation axis, and that transmits drive force from the first transmission member to the driven member. Any one of the first transmission member and the second transmission member includes a projection that projects from the base of the one of the transmission members, and the other transmission member includes a receiving port in the base of the other transmission member. The receiving port receives the projection. The receiving port is allowed to receive the projection when a rotation angle between the second transmission member and the first transmission member is an angle set in advance while not being allowed to receive the projection when the rotation angle is out of the angle set in advance, at the time of mounting the driven member on the apparatus body.

BRIEF DESCRIPTION OF THE DRAWINGS

Exemplary embodiment(s) of the present invention will be described in detail based on the following figures, wherein.

DETAILED DESCRIPTION

Hereinafter, a detail description will be given of exemplary embodiments of the present invention with reference to attached drawings.

Figure 1:
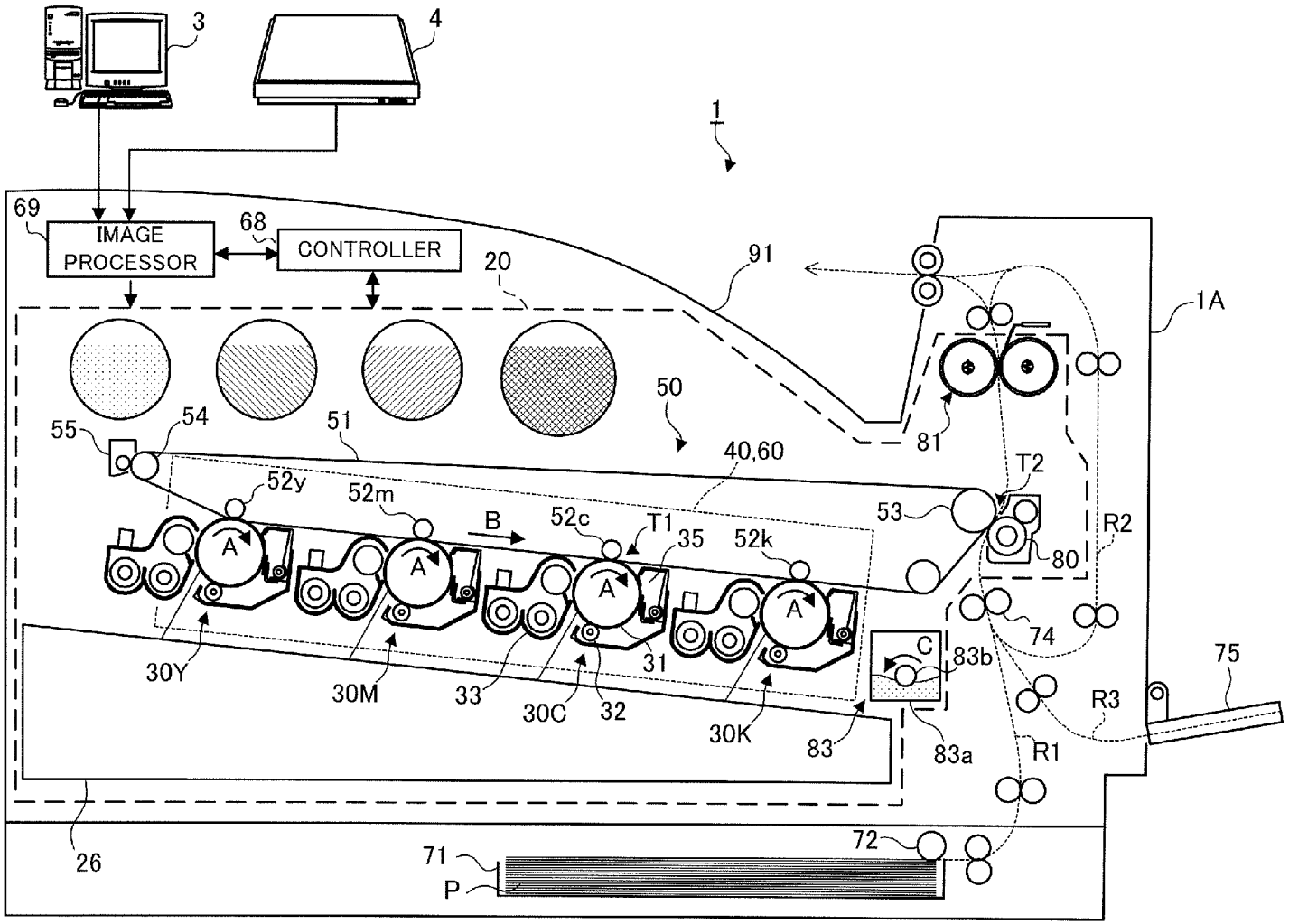
FIG. 1 is a diagram showing an entire configuration of an image forming apparatus to which the present invention is applied.

FIG. 1 is a diagram showing an entire configuration of an image forming apparatus to which the present invention is applied. The image forming apparatus 1 shown in FIG. 1 is an electrophotographic digital color printer with a so-called tandem type. The image forming apparatus 1 is provided with a body of the apparatus (apparatus body) 1A, and an image forming processor 20 that performs image formation in accordance with image data of respective colors is provided inside the apparatus body 1A. Further, the image forming apparatus 1 is provided with a controller 68 that controls operation of respective units and devices provided inside the apparatus body 1A. Furthermore, the image forming apparatus 1 is provided with an image processor 69 that performs a certain image processing on image data received from, for example, a personal computer (PC) 3, a scanner 4 or the like, and a main memory (not shown in the figure) that is realized by, for example, a HDD (hard disk drive) in which a processing program, image data and the like are stored.

In the image forming processor 20, four image forming units 30Y, 30M, 30C and 30K (hereinafter, also collectively referred to as "image forming units 30") are arranged in parallel at a certain interval in a lateral direction. Each of the image forming units 30 is provided with a photoconductor drum 31 as an example of image carriers that forms an electrostatic latent image while rotating in an arrow A direction, a charging roll 32 that charges a surface of the photoconductor drum 31, a development device 33 that develops the electrostatic latent image formed on the photoconductor drum 31 with each color toner, and a drum cleaner 35 that cleans the surface of the photoconductor drum 31 after transfer. In this configuration, each of the image forming units 30 is disposed so as to be replaceable from (detachably attachable to) the apparatus body 1A. For example, when the photoconductor drum 31 reaches its life cycle, the image forming unit 30 is replaced as one unit. It should be noted that, in the present exemplary embodiment, these four image forming units 30Y, 30M, 30C and 30K are taken as an image forming part.

A charging roll 32 is formed of a roll member in which a conductive elastic body layer and a conductive surface layer are stacked on a conductive core bar made of aluminum, stainless steel or the like. The charging roll 32 receives charging bias voltage supplied from a charging power supply (not shown in the figure), and uniformly charges the surface of the photoconductor drum 31 at certain voltage while being driven to rotate with respect to the photoconductor drum 31.

The development device 33 holds a two-component developer composed of magnetic carriers and any one of yellow (Y) toner, magenta (M) toner, cyan (C) toner and black (K) toner in each of the image forming units 30, and develops the electrostatic latent image formed on the photoconductor drum 31 with each color toner.

The drum cleaner 35 has a plate member formed of a rubber material such as urethane rubber, and brings the plate member into contact with the surface of the photoconductor drum 31 to remove toner, paper dust and the like attached on the photoconductor drum 31.

Moreover, the image forming processor 20 is provided with a laser exposure device 26 that exposes the photoconductor drums 31 disposed in respective image forming units 30. The laser exposure device 26 acquires respective color image data from the image processor 69, and scans and exposes the surface of the photoconductor drum 31 of each of the image forming units 30 with laser light that is light-controlled on the basis of the acquired image data.

Further, the image forming processor 20 is provided with a belt unit 50 as an example of a driven member. Here, the belt unit 50 is provided so as to be detachably attachable to the apparatus body 1A (so as to be detachable from the apparatus body 1A toward a front side (a front side of the figure)) in order to perform maintenance and the like, and in order to attach a new belt unit 50. The belt unit 50 is provided with an intermediate transfer belt 51 as an example of a belt member, primary transfer rolls 52*y*, 52*m*, 52*c* and 52*k*, a driving roll 53, and an idle roll 54.

Here, the intermediate transfer belt 51 is an endless belt member. While being stretched by at least the idle roll 54 and the driving roll 53, the intermediate transfer belt 51 is circularly moved by the driving roll 53 that is driven by a motor (not shown in the figure) excellent in a constant speed. On the intermediate transfer belt 51, respective color toner images formed on the respective photoconductor drums 31 of the image forming units 30 are superimposingly transferred.

Each of the primary transfer rolls 52*y*, 52*m*, 52*c* and 52*k* is arranged inside the intermediate transfer belt 51 and is arranged at a position so as to be opposed to each photoconductor drum 31. Each of the primary transfer rolls 52*y*, 52*m*, 52*c* and 52*k* sequentially transfers (primarily transfers) each color toner image in the image forming unit 30 onto the intermediate transfer belt 51 at a primary transfer portion T1 by forming a transfer electric field between each of the primary transfer rolls 52*y*, 52*m*, 52*c* and 52*k* and corresponding one of the photoconductor drums 31.

Further, the image forming processor 20 is provided with a secondary transfer roll 80 that collectively transfers (secondarily transfers) superimposed toner images that have been transferred onto the intermediate transfer belt 51 of the belt unit 50 onto a paper sheet P as a recording medium (recording paper) at a secondary transfer portion T2, and a fixing device 81 that fixes secondarily-transferred images onto the paper sheet P.

Furthermore, the image forming processor 20 is provided with a reclaimed container 83 for reclaiming toner, paper dust and the like that have been removed by a drum cleaner 35 and a belt cleaner 55 (described later), and have been transported via a transporting path (not shown in the figure). Here, the reclaimed container 83 is attached to the apparatus body 1A so as to be pulled toward the front side of the apparatus body 1A. In other words, the reclaimed container 83 is arranged so as to be detachably attachable to the apparatus body 1A. For example, when the reclaimed container 83 is filled with a toner and the like, the reclaimed container 83 is pulled out by a user or the like, and then a new reclaimed container 83 is pushed into the apparatus body 1A. The reclaimed container 83 is provided with a container body 83*a* that contains reclaimed toner and the like, and a transporting member 83*b*. The transporting member 83*b* is formed into a spiral shape, and the transporting member 83*b* rotates in an arrow C direction shown in the figure by receiving drive force from a drive source (not shown in the figure) to transport toner and the like in the container body 83*a*.

Furthermore, the image forming processor 20 is provided with a first driving unit 40 that causes respective photoconductor drums 31 of the image forming units 30 to be driven to rotate, at a rear side (back side) of the apparatus body 1A. The image forming processor 20 is further provided with a second driving unit 60 that causes the drive force from the first driving unit 40 not to be transmitted to some of the photoconductor drums 31, while causing the intermediate transfer belt 51 to be separated (refracted) from the some of the photoconductor drums 31.

In the image forming apparatus 1 of the present exemplary embodiment, the image forming processor 20 performs an image forming operation under the control by the controller 68. Specifically, image data inputted from the PC 3, the scanner 4 or the like is subjected to a certain image processing by the image processor 69, and the resultant data are transmitted to the laser exposure device 26. Then, for example, in the cyan (C) image forming unit 30C, the surface of the photoconductor drum 31 that has been uniformly charged at a certain potential by the charging roll 32 is scanned and exposed by the laser exposure device 26 with a light-controlled laser light on the basis of the image data from the image processor 69, and thus an electrostatic latent image is formed on the photoconductor drum 31. The formed electrostatic latent image is developed by the development device 33, and a cyan (C) toner image is formed on the photoconductor drum 31. Similarly to this operation, in the image forming units 30Y, 30M and 30K, yellow (Y), magenta (M) and black (K) toner images are formed, respectively.

Then, the respective color toner images formed in the respective image forming units 30 are electrostatically transferred, in sequence, onto the intermediate transfer belt 51 that circularly moves in an arrow B direction in FIG. 1 by the primary transfer rolls 52*y*, 52*m*, 52*c* and 52*k* to which certain primary transfer bias is applied from a transfer power supply (not shown in the figure). Thus, superimposed toner images are formed on the intermediate transfer belt 51. Then, the superimposed toner images are transported to the secondary transfer portion T2 in which the secondary transfer roll 80 and the driving roll 53 are disposed, in accordance with movement of the intermediate transfer belt 51.

On the other hand, a paper sheet P as an example of a transfer medium is taken out from a paper sheet holder 71 by a pick-up roll 72 for paper feeding, and is transported, along the transporting path R1, to a position of register rolls 74 for regulating a position of the paper sheet P. The paper sheet P is transported to the secondary transfer portion T2 from the register rolls 74 in synchronization with timing when the superimposed toner images are transported to the secondary transfer portion T2. At the secondary transfer portion T2, by an action of the transfer electric field formed between the secondary transfer roll 80 to which the secondary transfer bias voltage is applied and the driving roll 53, the superimposed toner images are collectively and electrostatically transferred (secondarily transferred) onto the paper sheet P. It should be noted that, to the secondary transfer portion T2, a paper sheet P is also transported via a transporting path R2 for double-side printing or a transporting path R3 from a manual paper sheet holder 75.

Thereafter, the paper sheet P onto which the superimposed toner images have been electrostatically transferred is peeled from the intermediate transfer belt 51, and is transported to the fixing device 81. Unfixed toner images on the paper sheet P that has been transported to the fixing device 81 are fixed on the paper sheet P through a fixing processing by the fixing device 81 with heat and pressure. Then the paper sheet P on which a fixed image has been formed is transported to a paper sheet stacking unit 91 that is provided at an exit portion of the image forming apparatus 1. On the other hand, toner (transfer remaining toner) and the like attached on the intermediate transfer belt 51 after the secondary transfer are removed by the belt cleaner 55 arranged so as to be in contact with the intermediate transfer belt 51, and the intermediate transfer belt 51 prepares for a next image forming cycle. It should be noted that, the toner and the like removed by the belt cleaner 55 are transported to the reclaimed container 83 via the transporting path not shown in the figure, as described above.

Continuously, a description will be given of the belt unit 50 in more detail. Here, FIGS. 2A and 2B are views for explaining the belt unit 50.

In the image forming apparatus 1 according to the present exemplary embodiment, when image formation is performed by using the yellow (Y) image forming unit 30Y, the magenta (M) image forming unit 30M, the cyan (C) image forming unit 30C and the black (K) image forming unit 30K, that is, when full-color image formation is performed, the intermediate transfer belt 51 is disposed so as to be brought into contact with all the photoconductor drums 31. Alternatively, when image formation is performed by using only the black (K) image forming unit 30K, that is, when single-color image formation is performed, the intermediate transfer belt 51 is disposed so as to be separated from the photoconductor drums 31 of the image forming units 30Y, 30M and 30C. It should be noted that, in the present exemplary embodiment, a case of the full-color image formation may be taken as a first mode, while a case of the single-color image formation may be taken as a second mode. Further, in the present exemplary embodiment, photoconductor side coupling members 18, drive side coupling members 43, advancing/retracting members 70, and a movable plate 61 that are described later may be taken as a setting mechanism. Furthermore, a cam 563, a second supporting member 562, and a coil spring 564 that are also described later may be taken as an arrangement mechanism. Furthermore, the cam 563 and the second supporting member 562 that are also described later may be taken as a separation mechanism.

Figure 2A:
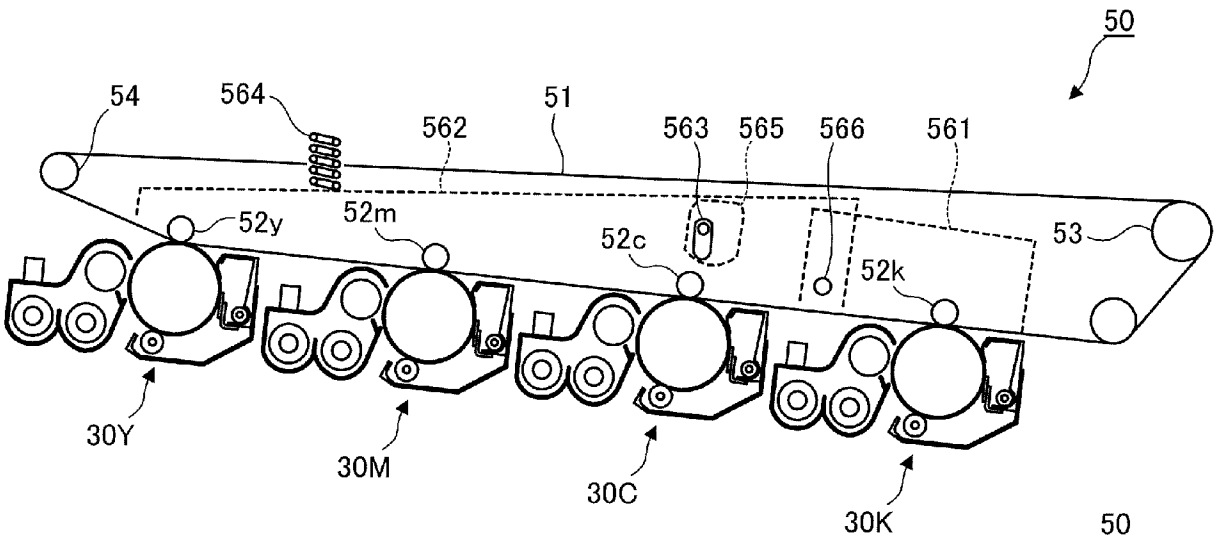
FIGS. 2A and 2B are views for explaining the belt unit.
Figure 2B:
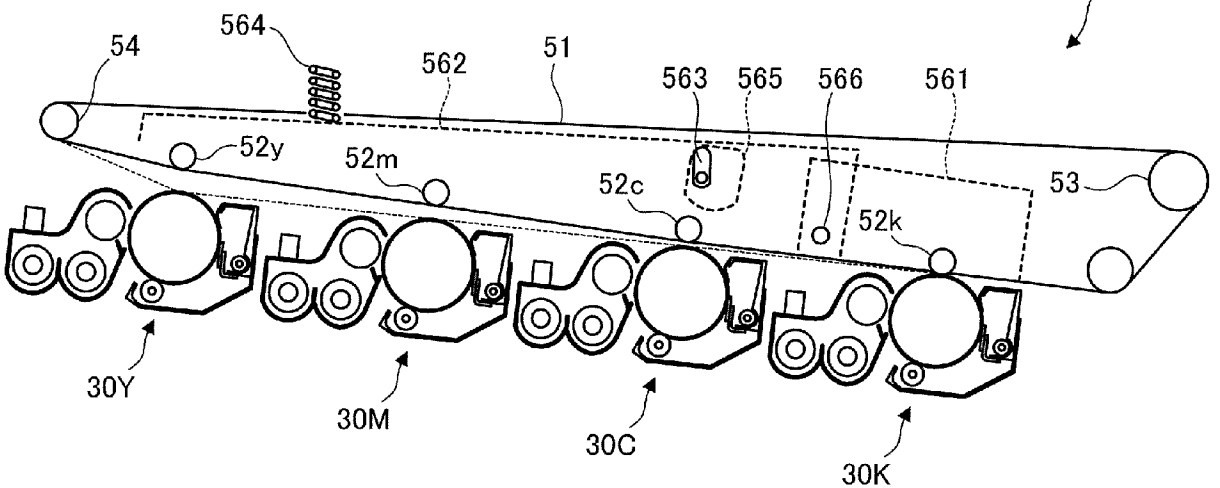

More specifically, as shown in FIG. 2A, the belt unit 50 according to the present exemplary embodiment is provided with a first supporting member 561 that rotatably supports the primary transfer roll 52*k*, and the second supporting member 562 that rotatably supports the primary transfer rolls 52*y*, 52*m* and 52*c*, on an inner circumferential side of the intermediate transfer belt 51. Further, the belt unit 50 is provided with the cam 563 that is disposed in a state where rotation of at least 180 degrees is permitted and that is rotationally (swingingly) driven by the second driving unit 60, and the coil spring 564 that presses the second supporting portion 562 toward the image forming units 30.

Here, the second supporting unit 562 is disposed at a position opposed to the image forming units 30Y, 30M and 30C through the intermediate transfer belt 51. Further, the second supporting unit 562 is provided with a penetration hole portion 565 inside which the cam 563 is disposed, above the image forming unit 30C. Between the first supporting member 561 and the second supporting member 562, a fulcrum 566 for rotating (swinging) the second supporting member 562 with respect to the first supporting member 561 is provided.

In the present exemplary embodiment, when the single-color image formation is performed by using the image forming unit 30K, the cam 563 is rotated by the second driving unit 60 in a counter-clockwise direction in the figure, and the cam 563 presses the second supporting member 562 upward, against the pressing force of the coil spring 564. Thereby, the second supporting member 562 rotates around the fulcrum 566 as a rotation center in a clockwise direction in the figure. As a result, as shown in FIG. 2B, the intermediate transfer belt 51 is separated from the photoconductor drums 31 of the image forming units 30Y, 30M and 30C (a first arrangement state).

Subsequently, when the intermediate transfer belt 51 is separated from the photoconductor drums 31 of the image forming units 30Y, 30M and 30C, the rotation of the photoconductor drums 31 (photoconductor drums 31 of the image forming units 30Y, 30M and 30C) according to the movement of the intermediate transfer belt 51 is stopped. Although the detail description will be given later, when the intermediate transfer belt 51 is separated from the photoconductor drums 31 of the image forming units 30Y, 30M and 30C, rotation drive of the photoconductor drums 31 of the image forming units 30Y, 30M and 30C is also stopped by the second driving unit 60.

In order that the intermediate transfer belt 51 is brought into contact with the photoconductor drums 31 again, that is, in order that a second arrangement state is set in which the intermediate transfer belt 51 is in contact with respective photoconductor drums 31 of the image forming units 30Y, 30M and 30C, the cam 563 in the state shown in FIG. 2B is rotated in the clockwise direction in the figure, and the second supporting member 562 is rotated by the coil spring 564 in the counterclockwise direction in the figure.

Figure 3:
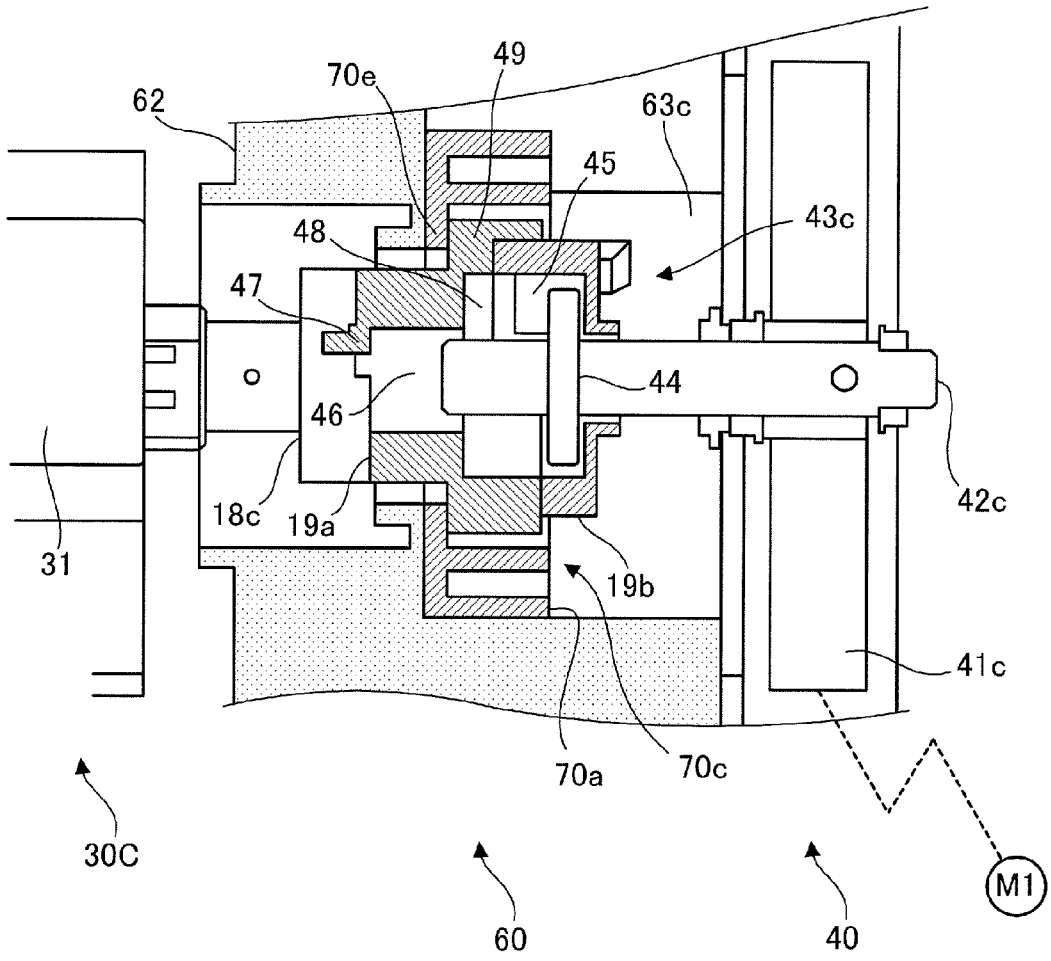
FIG. 3 is a view for explaining the first driving unit and the second driving unit.

FIG. 3 is a view for explaining the first driving unit 40 and the second driving unit 60. In the image forming apparatus 1 according to the present exemplary embodiment, as described above, the first driving unit 40 and the second driving unit 60 are provided on the rear side of the apparatus body 1A. It should be noted that, in this figure, a side view of the image forming unit 30C (a rear side of the image forming unit 30C) is shown.

As shown in the figure, the image forming unit 30C according to the present exemplary embodiment is provided with a photoconductor side coupling member 18*c* (hereinafter, also referred to as a "photoconductor side coupling member 18") that is attached to the photoconductor drum 31 at a side portion of the image forming unit 30C, and rotates in conjunction with the photoconductor drum 31.

On the other hand, the first driving unit 40 is provided with a motor M1 and a drive side coupling member 43*c* (hereinafter, also referred to as a "drive side coupling member 43") that is provided corresponding to the photoconductor coupling member 18*c* and that is rotationally driven by drive force generated in the motor M1.

Further, in the present exemplary embodiment, the drive side coupling member 43*c* is coupled to the corresponding photoconductor side coupling member 18*c*. As a result, the photoconductor drum 31 of the image forming unit 30C receives drive force from the motor M1, and is rotationally driven. It should be noted that, to all the photoconductor drums 31 in the present exemplary embodiment (all the photoconductor drums 31 of the image forming units 30Y, 30M, 30C and 30K), the motor M1 supplies drive force. That is, all the photoconductor drums 31 receive drive force from the single motor M1.

Here, the first driving unit 40 is provided with a gear 41*c* that is rotated by the motor M1, a shaft 42*c* that rotates in conjunction with the gear 41*c*, a pin 44 that is disposed so as to be penetrated by the shaft 42*c*. The both edge portions of the pin 44 protrude from the outer circumferential face of the shaft 42*c*. In addition, the first driving unit 40 is provided with the above-described drive side coupling member 43*c*.

The pin 44 is disposed inside the drive side coupling member 43*c*, and is disposed so as to hit a hitting surface 45 formed inside the drive side coupling member 43*c* when the shaft 42*c* is rotationally driven by the motor M1. As a result, in conjunction with the rotation of the shaft 42*c*, the drive side coupling member 43*c* also rotates.

The drive side coupling member 43*c* is disposed so as to be slidable along the axial direction of the shaft 42*c*. More specifically, the drive side coupling member 43*c* in the present exemplary embodiment is provided with a penetration-hole portion 46 that is formed with a larger diameter than that of the shaft 42*c*, and is disposed so as to be penetrated from a side closer to the first driving unit 40 to a side closer to the image forming unit 30C. Inside the penetration hole portion 46, the shaft 42*c* is disposed. In addition, the drive side coupling member 43*c*, as described above, is provided with the hitting surface 45. The hitting surface 45 is formed to be flat, and is disposed along the axial direction of the shaft 42*c*. Further, the drive side coupling member 43*c* is provided with an inward protruding portion 47 that protrudes inside the penetration-hole portion 46, on a side closer to the photoconductor side coupling member 18*c*. The inward protruding portion 47 hits an end portion of the shaft 42*c*, when the drive side coupling member 43*c* slides toward the first driving unit 40.

Further, the drive side coupling member 43*c* is provided with a concave-groove portion 48 that is formed from the penetration-hole portion 46 to the outside of the drive side coupling member 43*c*, and is disposed so as to surround the outer circumferential face of the shaft 42*c*, on the side closer to the photoconductor side coupling member 18*c* than the hitting surface 45. When the drive side coupling member 43*c* slides toward the first driving unit 40 and the inward protruding portion 47 reaches the end portion of the shaft 42*c*, the pin 44 is rotatably disposed in the concave-groove portion 48. Further, the drive side coupling member 43*c* is provided with an outward protruding portion 49 that protrudes outside, at the outer circumferential portion thereof.

On the other hand, the second driving unit 60 according to the present exemplary embodiment is provided with an advancing/retracting member 70*c* (hereinafter, also referred to as an "advancing/retracting member 70") that advances to or retracts from the photoconductor side coupling member 18*c*, in conjunction with a slide of a movable plate 61 described later in detail (refer to FIG. 6). The advancing/retracting member 70*c* is contained in a container portion 63*c* (hereinafter, also referred to as a "container portion 63") formed in a housing 62 of the second driving unit 60 in a rotatable state. Here, the advancing/retracting member 70*c* according to the present exemplary embodiment is provided with an inward protruding portion 70*e* that protrudes inward, at the inner circumferential face of the ring portion 70*a* formed into a ring shape.

The drive side coupling member 43*c* according to the present exemplary embodiment is disposed inside the ring portion 70*a*. The drive side coupling member 43*c* is pushed by the coil spring that is not shown in the figure, and consequently, while the outward protruding portion 49 hits the inward protruding portion 70*e*, the advancing/retracting member 70*c* hits the housing 62. As a result, the drive side coupling member 43*c* is positioned at a certain position in the container portion 63*c*, which is set in advance. Further, while the end portion of the drive side coupling member 43*c* is exposed from the advancing/retracting member 70*c*, the end portion is coupled to the photoconductor side coupling member 18*c*. It should be noted that the drive side coupling member 43*c* according to the present exemplary embodiment is configured by assembling two members: one is a coupling member 19*a* coupled to the photoconductor side coupling member 18*c*, and the other is a supporting member 19*b* that supports the coupling member 19*a*.

Figure 4:
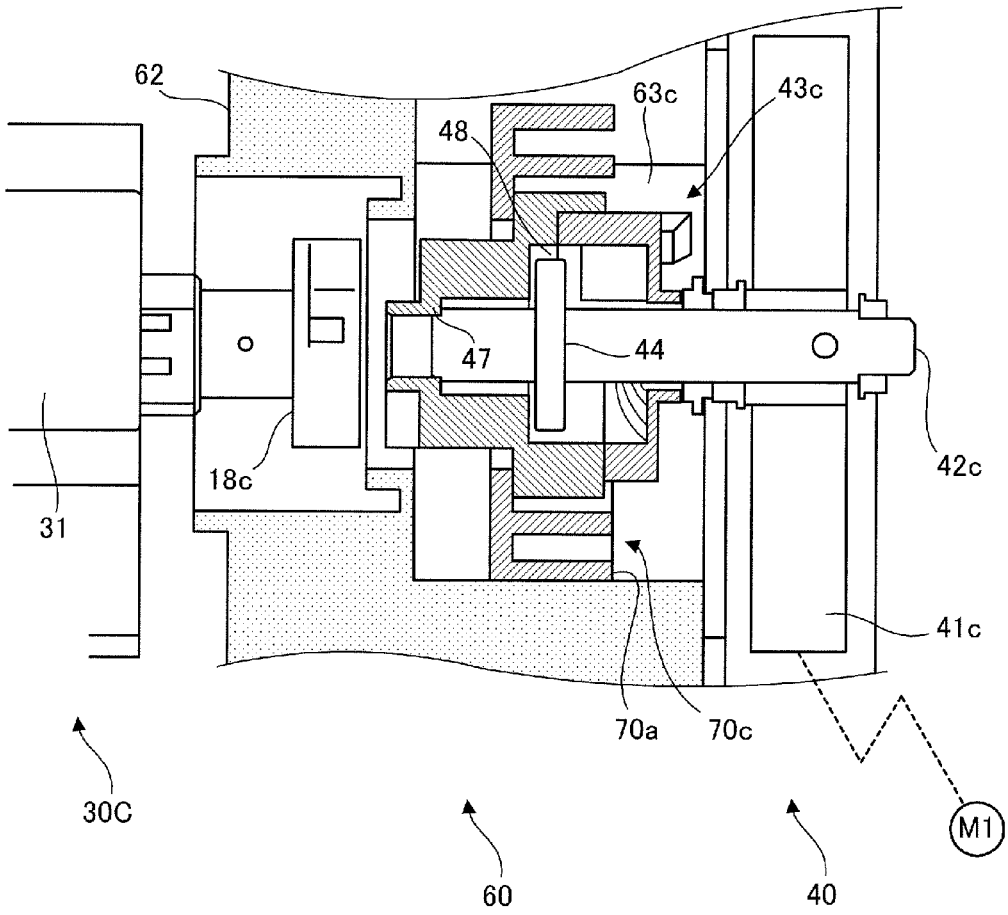
FIG. 4 shows a state after the advancing/retracting member rotates.

Here, FIG. 4 shows a state after the advancing/retracting member 70*c* rotates. Further, FIG. 5 shows an inside of the container portion 63*c*.

Figure 5:
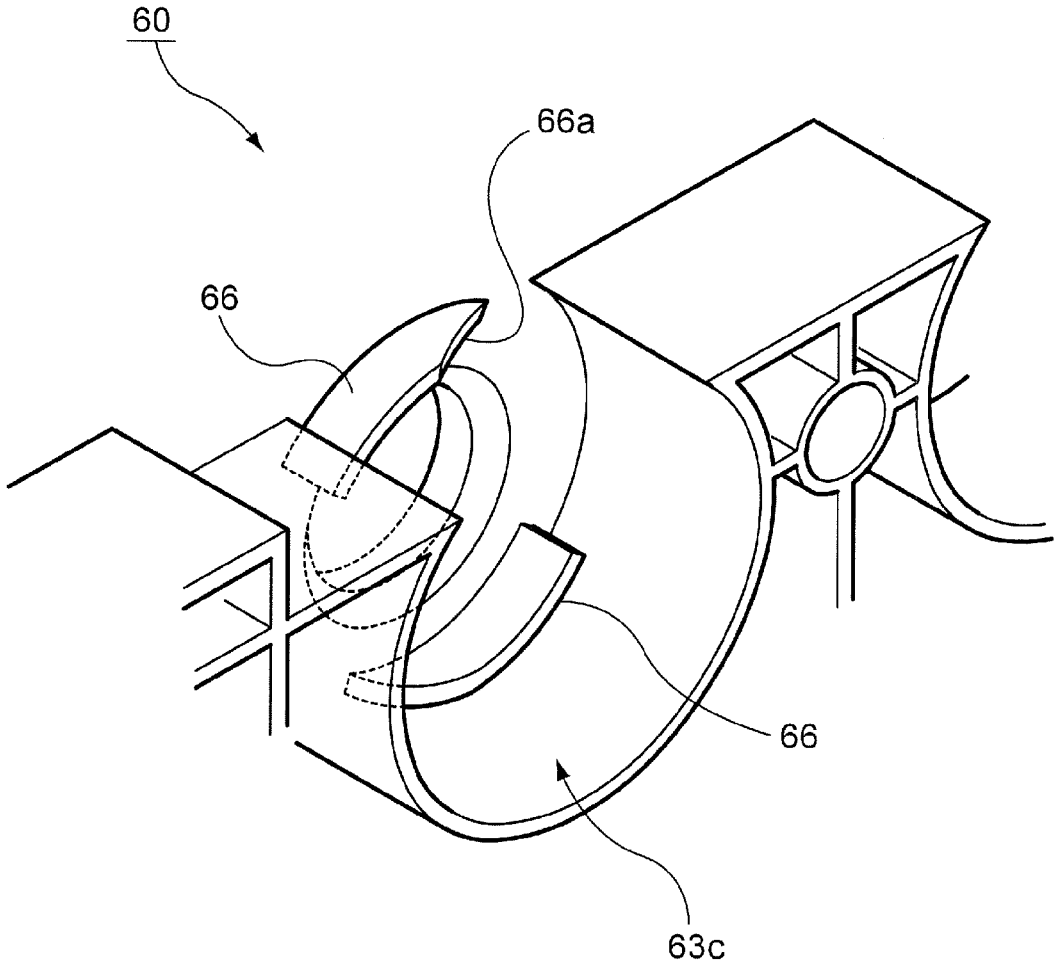
FIG. 5 shows an inside of the container portion.

Although a description has been omitted in FIG. 3, the second driving unit 60 according to the present exemplary embodiment is provided with a protruding portion 66 (the illustration thereof is omitted in FIG. 4) that is formed in a rib shape, and that protrudes from a bottom of the container portion 63*c*, as shown in FIG. 5. The protruding portion 66 has an inclined face 66*a* formed so as to gradually away from the bottom of the container portion 63*c*. When the advancing/retracting member 70*c* is rotated by the slide of the movable plate 61, the advancing/retracting member 70*c* is guided by this inclined face 66*a* to move (to be retracted) in a direction away from the photoconductor side coupling member 18*c*. After that, when the advancing/retracting member 70*c* moves in the direction away from the photoconductor side coupling member 18*c*, the drive side coupling member 43*c* also moves (slides) in the direction away from the photoconductor side coupling member 18*c*, as shown in FIG. 4. As a result, as shown in the figure, coupling between the photoconductor side coupling member 18*c* and the driving side coupling member 43*c* is released. Further, by this operation, rotation of the photoconductor drum 31 caused by the drive side coupling member 43*c* is stopped. It should be noted that, in this state, rotation of the drive side coupling member 43*c* is also stopped because the pin 44 is located inside the concave-groove portion 48.

It should be noted that, each of side portions of the image forming units 30Y and 30M (the rear side of the image forming units 30Y and 30M) is similarly configured as the side portion of the above-described image forming unit 30C. In contrast, the image forming unit 30K is provided with the photoconductor side coupling member 18 and the drive side coupling member 43, but is not provided with the advancing/retracting member 70.

Therefore, when the movable plate 61 slides, coupling between the photoconductor side coupling member 18 and the drive side coupling member 43 that are provided corresponding to the image forming unit 30K is maintained, while coupling between the photoconductor side coupling member 18 and the drive side coupling member 43 that are provided each of the image forming units 30Y, 30M and 30C is released. As a result, when the movable plate 61 slides, only the photoconductor drum 31 of the image forming unit 30K is rotationally driven for performing image formation by using the image forming unit 30K, that is, a single color image formation.

It should be noted that, in this description, for descriptive purposes, the photoconductor side coupling member 18 provided corresponding to the image forming unit 30Y is referred to as a photoconductor side coupling member 18*y*, and the drive side coupling member 43 provided corresponding to the image forming unit 30Y is referred to as a drive side coupling member 43*y*. Similarly, those corresponding to the image forming unit 30M are referred to as a photoconductor side coupling member 18*m* and a drive side coupling member 43*m*, respectively. Further, those corresponding to the image forming unit 30*k* are referred to as a photoconductor side coupling member 18*k* and a drive side coupling member 43*k*, respectively. It should be noted that, in the present exemplary embodiment, the photoconductor side coupling member 18, the drive side coupling member 43 and the advancing/retracting member 70 are taken as a carrier-side receiving member, a drive-side transmission member, and a release member, respectively.

Figure 6:
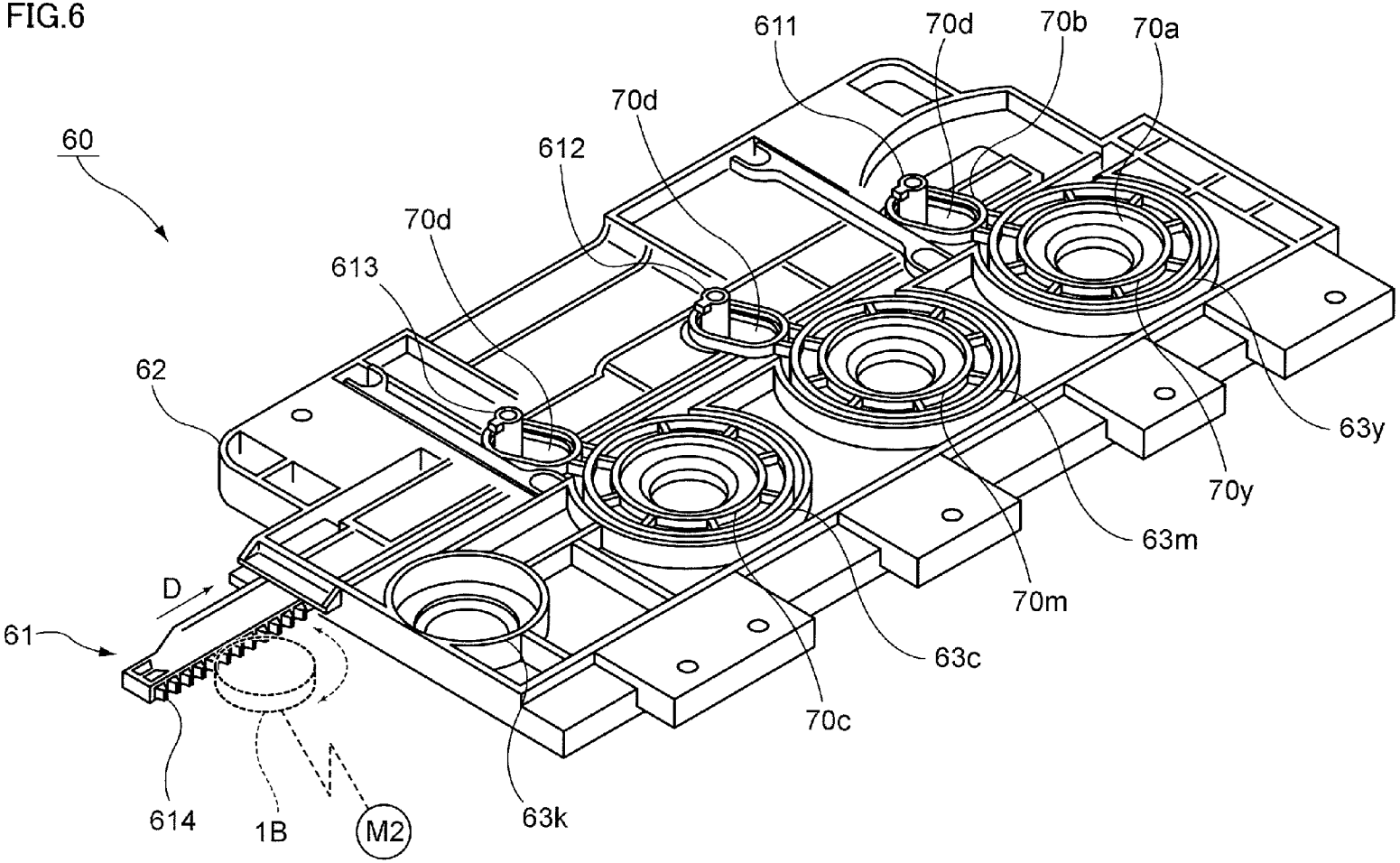
FIG. 6 shows the second driving unit seen from the rear side of the apparatus body.

FIG. 6 shows the second driving unit 60 seen from the rear side of the apparatus body 1A.

As described above, the second driving unit 60 is provided with the movable plate 61 (an example of a drive force supplying member), and the advancing/retracting members 70. In addition, the second driving unit 60 is provided with a housing 62 that supports these members.

The housing 62 is provided with four container portions 63*y*, 63*m*, 63*c* and 63*k* at positions respectively corresponding to the image forming units 30. In the container portions 63*y*, 63*m* and 63*c* among these four container portions 63*y*, 63*m*, 63*c* and 63*k*, the advancing/retracting members 70*y*, 70*m* and 70*c* provided corresponding to respective image forming units 30Y, 30M and 30C are contained.

Here, each of the advancing/retracting members 70*y*, 70*m* and 70*c* is provided with the above-described ring portion 70*a* that has a penetration hole portion at the center and is formed into a ring shape, an arm portion 70*b* that protrudes outward from the ring part 70*a*, and a penetration-hole portion 70*d* that is formed into a long hole shape at the end portion of the arm portion 70*b*.

On the other hand, the movable plate 61 is formed into a long and thin plate shape, and is arranged so as to be slidable along an arrangement direction of the image forming units 30 (the advancing/retracting members 70*y*, 70*m* and 70*c*). Moreover, the movable plate 61 is provided with, at one end portion, a first protruding portion 611 that is arranged so as to penetrate the penetration-hole portion 70*d* of the advancing/retracting member 70*y*. In addition to this, the movable plate 61 is provided with a second protruding portion 612 and a third protruding portion 613 in this order from the one end portion to the other end portion. Here, the second protruding portion 612 is disposed so as to penetrate the penetration-hole portion 70*d* of the advancing/retracting member 70*m*, and the third protruding portion 613 is disposed so as to penetrate the penetration-hole portion 70*d* of the advancing/retracting member 70*c*. Further, the movable plate 61 is provided with, at the other end portion, a first rack gear 614 that is engaged with a driving gear 1B which is rotationally driven by receiving drive force from the motor M2 as an example of a drive source.

As shown in the figure, when the movable plate 61 protrudes from the housing 62, each of the advancing/retracting members 70*y*, 70*m* and 70*c* is in a state where, as shown in FIG. 4, they slide toward the first driving unit 40. Thus, coupling between each of the photoconductor side coupling members 18*y*, 18*m* and 18*c* and corresponding one of the drive side coupling members 43*y*, 43*m* and 43*c* is in a released state. As a result, image formation by using the image forming unit 30K, that is, a single color image formation may be performed under this state. Further, when the movable plate 61 is slid in a direction indicated by an arrow D in the figure, that is, as a further description, when the movable plate 61 is slid in a direction along the arrangement direction of the advancing/retracting members 70*y*, 70*m* and 70*c* arranged in parallel, each of the advancing/retracting members 70*y*, 70*m* and 70*c* rotates by pressure from the movable plate 61 (the common movable plate 61). By this operation, the photoconductor side coupling members 18*y*, 18*m* and 18*c* are coupled to the drive side coupling members 43*y*, 43*m* and 43*c*, respectively, and thus full-color image formation may be performed.

Figure 7:
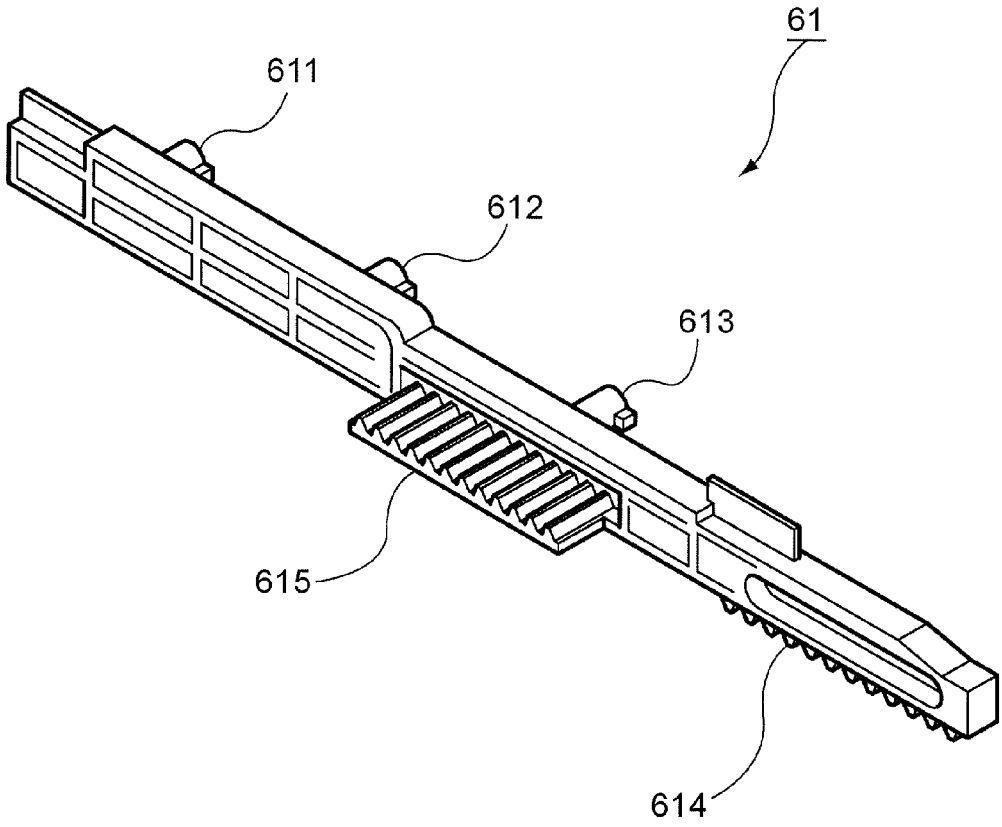
FIG. 7 shows the movable plate seen from a back side.

Here, FIG. 7 shows the movable plate 61 seen from a back side. As an additional note, FIG. 7 shows a state where the movable plate 61 is seen from the front side of the apparatus body 1A.

As shown in the figure, the movable plate 61 according to the present exemplary embodiment is provided with a second rack gear 615 (a second contact portion) on a side surface opposite to a side surface where the first protruding portion 611 to the third protruding portion 613 (a first contact portion) are provided, and on a rear side of the third protruding portion 613.

Subsequently, a description will be given of the second driving unit 60.

Figure 8:
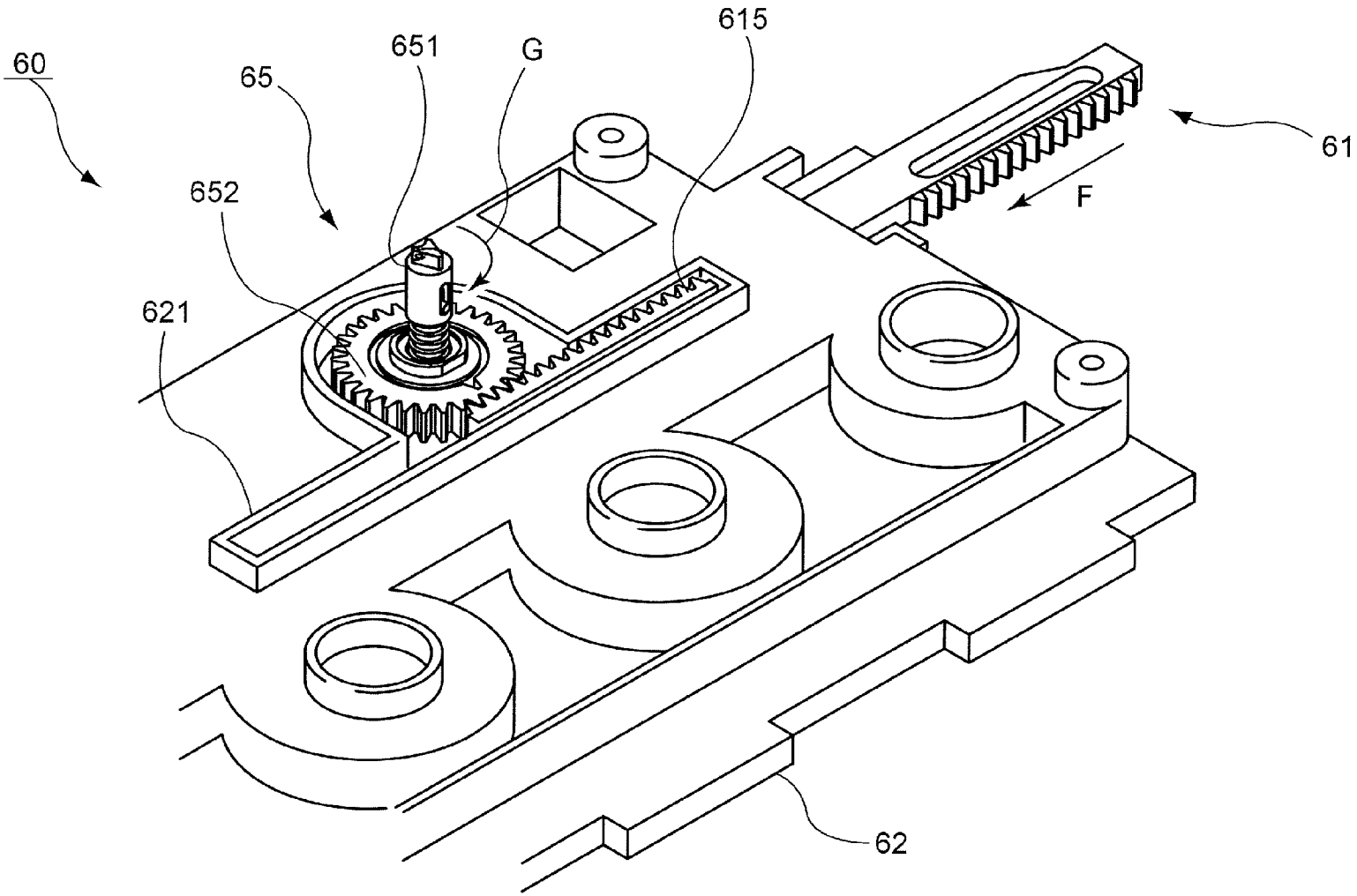
FIG. 8 shows the second driving unit seen from the front side of the apparatus body.
Figure 9:
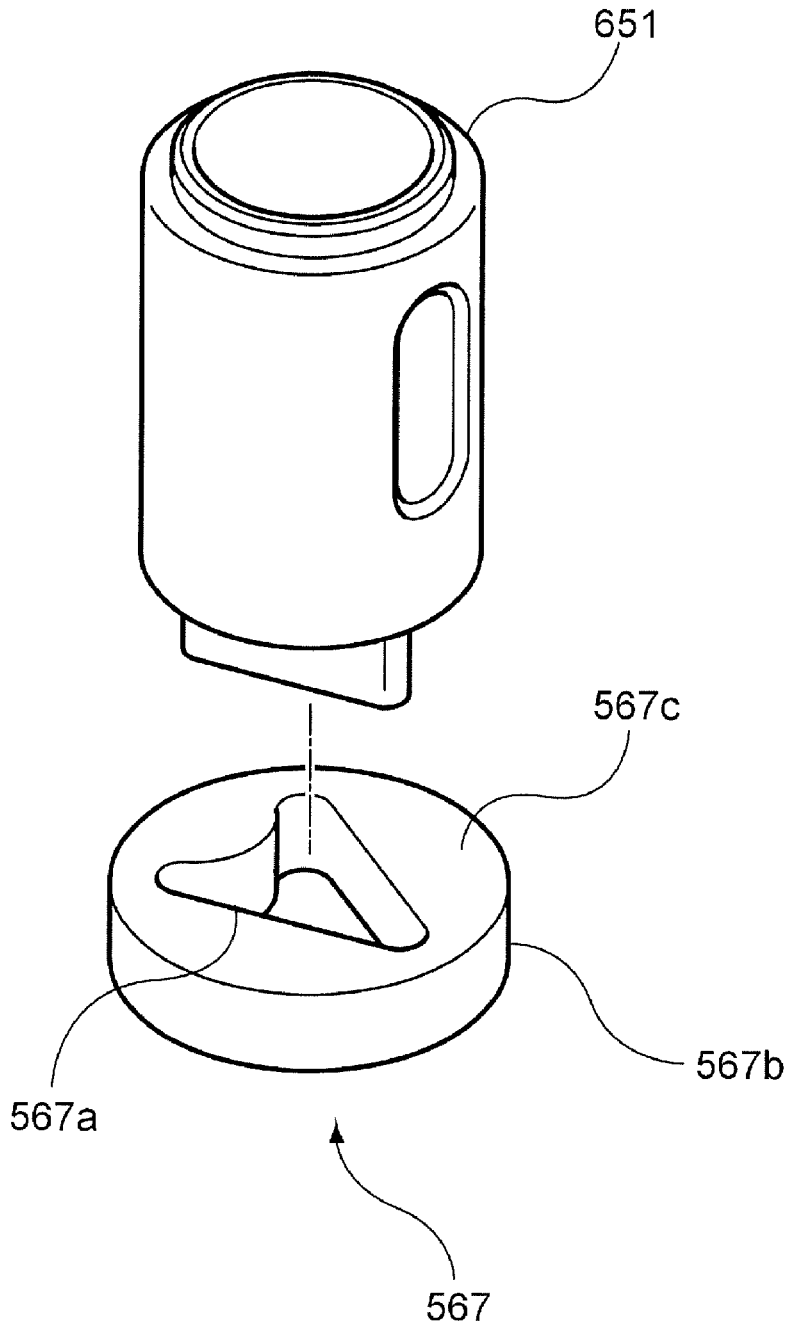
FIG. 9 shows a part of a transmission mechanism in the second driving unit.

FIG. 8 shows the second driving unit 60 seen from the front side of the apparatus body 1A, and FIG. 9 shows a part of a transmission mechanism 65 in the second driving unit 60.

Here, the second driving unit 60 has an opening portion 621 that is in a rectangular-like shape and that is disposed so as to penetrate the housing 62 from the rear side to the front side, as shown in FIG. 8. The opening portion 621 is provided along a sliding direction of the movable plate 61. In addition, in the opening portion 621, the second rack gear 615 of the movable plate 61 is arranged. Further, the second driving unit 60 has the transmission mechanism 65 that transmits drive force from the movable plate 61 to the cam 563 (refer to FIG. 2) provided in the belt unit 50. Here, the above-described second rack gear 615 is to be in an engagement state with a gear 652 (which will be described later in detail) in the transmission mechanism 65.

Here, the transmission mechanism 65 is provided with a transmission side coupling member 651 (an example of a first transmission member, a transmission member and a coupling member) that transmits drive force to the cam 563 by rotating in conjunction with the sliding of the movable plate 61. It should be noted that the transmission side coupling member 651 transmits the drive force to the cam 563 by coupling to a cam side coupling member 567 (an example of a second transmission member and a receiving member) provided so as to move in conjunction with the cam 563, as shown in FIG. 9.

As shown in FIG. 8, when the movable plate 61 protrudes from the housing 62, the cam 563 becomes in an upward state and thus the intermediate transfer belt 51 becomes in a state of separation from the respective photoconductor drums 31 of the image forming units 30Y, 30M and 30C, as shown in FIG. 2B. In addition, when the movable plate 61 protrudes from the housing 62, the advancing/retracting members 70*y*, 70*m* and 70*c* become in a state where they slide toward the first driving unit 40 (refer to FIG. 4) and the coupling between each of the photoconductor side coupling members 18*y*, 18*m* and 18*c* and corresponding one of the drive side coupling members 43*y*, 43*m* and 43*c* becomes in a released state, as described above. In other words, while the intermediate transfer belt 51 is separated from the respective photoconductor drums 31 of the image forming units 30Y, 30M and 30C, the drive force to the respective photoconductor drums 31 of the image forming units 30Y, 30M and 30C is not transmitted. More specifically, while the photoconductor drum 31 of the image forming unit 30K and the intermediate transfer belt 51 are brought into contact with each other, only the photoconductor drum 31 of the image forming unit 30K is rotatable. That is, monochrome image formation may be performed.

On the other hand, when the movable plate 61 is slid toward a direction indicated by an arrow F in the figure, by the motor M2 (refer to FIG. 6), from the state shown in FIG. 8 to be pushed into the housing 62, the transmission side coupling member 651 rotates by 180 degrees in a direction indicated by an arrow G in the figure. As a result, as also shown in FIG. 2A, all the photoconductor drums 31 and the intermediate transfer belt 51 are brought into contact with each other. In addition, while rotating, the advancing/retracting members 70*y*, 70*m* and 70*c* are slid towards the photoconductor side coupling members 18*y*, 18*m* and 18*c*, respectively. Consequently, the photoconductor side coupling members 18*y*, 18*m* and 18*c* are coupled with the driving side coupling members 43*y*, 43*m* and 43*c*, respectively. Therefore, the full-color image formation may be performed. As described above, in the present exemplary embodiment, drive force is supplied from the motor M2 as a common drive source to the transmission side coupling member 651 and the advancing/retracting members 70*y*, 70*m* and 70*c*. In addition, in the present exemplary embodiment, the transmission side coupling member 651 may be considered to be provided in a state where the transmission side coupling member 651 moves in conjunction with the above-described setting mechanism configured by the advancing/retracting members 70, the movable plate 61 and the like.

Figure 10:
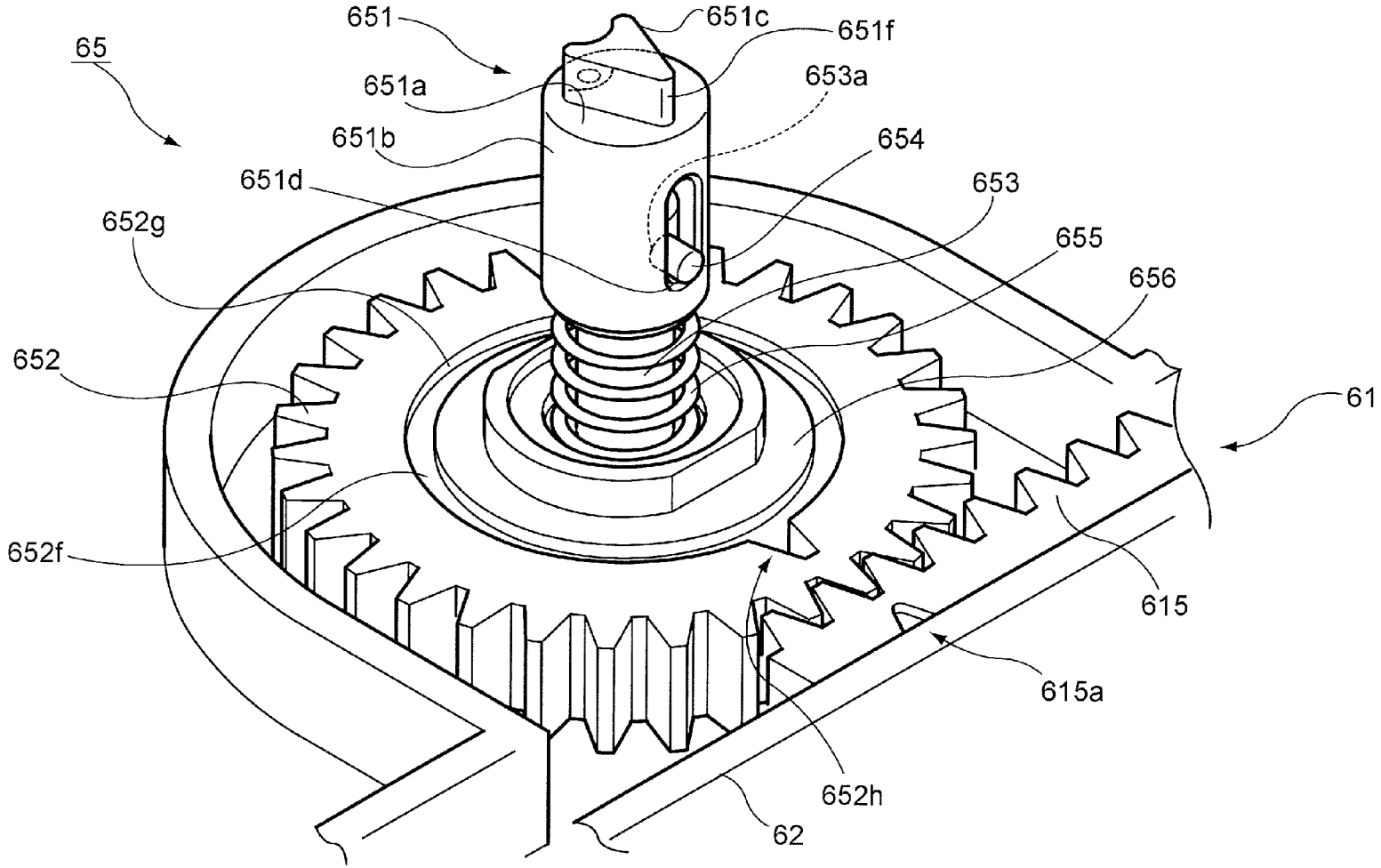
FIGS. 10 to 12 are views for explaining the transmission mechanism.
Figure 11:
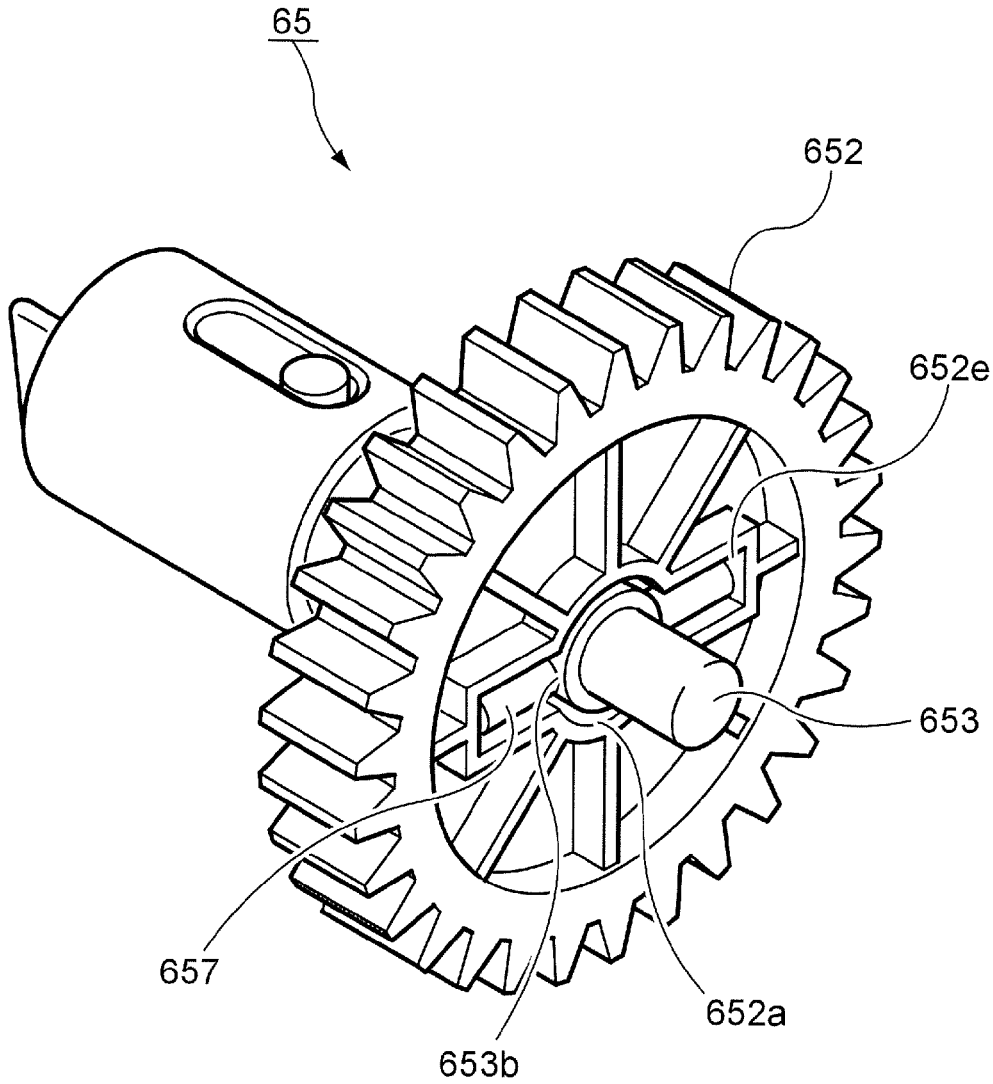
Figure 12:
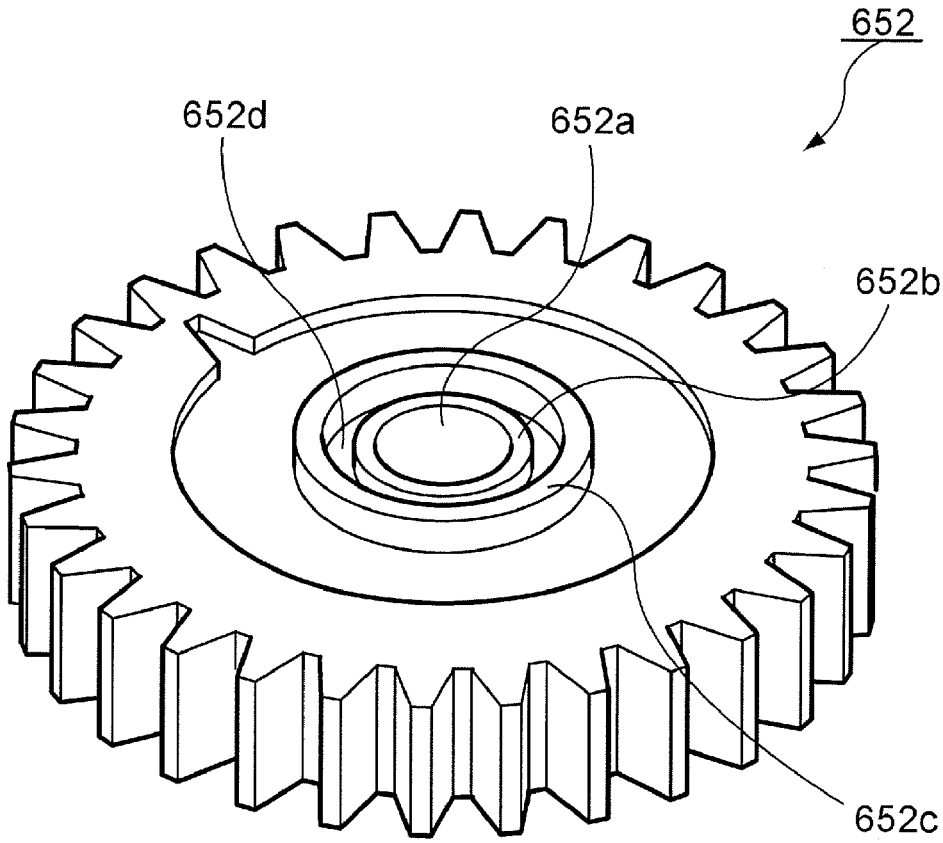

Here, FIGS. 10 to 12 are views for explaining the transmission mechanism 65.

As shown in FIG. 10, the transmission mechanism 65 is provided with a transmission side coupling member 651, a gear 652, a shaft 653, a first pin 654, a coil spring 655, and a bearing 656. In addition, as shown in FIG. 11, the transmission mechanism 65 is provided with a second pin 657.

Here, as shown in FIG. 10, the transmission side coupling member 651 is provided with a base portion 651*b* that has an end face 651*a* and that is formed into a cylindrical shape, and an engagement portion 651*c* (an example of a projection) that is provided on the end face 651*a* and is engaged with the cam side coupling member 567. Further, the base portion 651*b* is provided with a long-hole portion 651*d* formed along an axial direction of the base portion 651*b* and disposed so as to penetrate the base portion 651*b* from the inner circumferential face to the outer circumferential face thereof.

As shown in FIG. 12, the gear 652 is formed into a disk shape with a certain thickness. At the center thereof, a central-hole portion 652*a* into which the shaft 653 is inserted is provided. Around the central-hole portion 652*a*, a first protruding portion 652*b* is provided. The first protruding portion 652*b* cylindrically protrudes from a side of the gear 652. In addition, around of the first protruding portion 652*b*, a second protruding portion 652*c* is provided. The second protruding portion 652*c* also cylindrically protrudes from the side of the gear 652. It should be noted that the second protruding portion 652*c* is arranged at a certain distance from the first protruding portion 652*b*. Thus, between the first protruding portion 652*b* and the second protruding portion 652*c*, a ring-shaped groove portion 652*d* is formed. In addition, as shown in FIG. 11, the gear 652 has a concave groove portion 652*e*, on the other side (a back side), which is formed so as to go through the central-hole portion 652*a*. It should be noted that, the number of teeth of the gear 652 is double of the number of teeth of the second rack gear 615. For this reason, when the second rack gear 615 slides, the gear 652 (transmission mechanism 65) rotates by 180 degrees, as described above.

As shown in FIG. 10, the shaft 653 is provided with a first penetration hole portion 653*a*, on an end portion side, which is disposed so as to penetrate the shaft 653 in a direction orthogonal to an axial direction thereof. In addition, as shown in FIG. 11, on the other end portion, a second penetration hole portion 653*b* is provided. The second penetration hole portion 653*b* is also disposed so as to penetrate the shaft 653 in the direction orthogonal to the axial direction. As shown in FIG. 10, while the one end portion side of the shaft 653 is inserted into the base portion 651*b* of the transmission side coupling member 651, the other end portion side thereof is inserted into the central-hole portion 652*a* of the gear 652. Further, the first pin 654 is pressed into the first penetration hole portion 653 through the long-hole portion 651*d* of the base portion 651*b*, and the second pin 657 is inserted into the second penetration hole portion 653*b*. Here, while preventing the transmission side coupling member 651 from being slipped from the shaft 653, the first pin 654 guides the slide of the transmission side coupling member 651 with respect to the shaft 653. In addition, the first pin 654 allows the transmission side coupling member 651 to move in conjunction with the shaft 653. On the other hand, after inserted into the second penetration hole 653*b*, the second pin 657 is arranged inside the concave groove portion 652*e* in the gear 652 so as to allow the gear 652 and the shaft 653 to move in conjunction with each other.

As shown in FIG. 10, the coil spring 655 is arranged around the shaft 653 and arranged between the gear 652 and the transmission side coupling member 651, and the coil spring 655 biases the transmission side coupling member 651 in a direction away from the gear 652. Here, an end portion of the coil spring 655, which is closer to the gear 652, is arranged inside the groove portion 652*d* (refer to FIG. 12) of the gear 652, and thus displacement of the coil spring 655 is regulated. Further, since the coil spring 655 is arranged between the gear 652 and the transmission side coupling member 651, the coil spring 655 rotates in conjunction with (in synchronism with) the gear 652 and the transmission side coupling member 651 when the gear 652 is rotated by the movable plate 61.

As shown in FIG. 10, the bearing 656 is formed into a ring shape. The bearing 656 is disposed around the second penetrating portion 652*c* (refer to FIG. 12) in the gear 652. Further, the bearing 656 has a self-lubricating function, and thus the bearing 656 is configured as a so-called slippage bearing. Furthermore, the bearing 656 has cut-off portions at some parts of the outer circumferential face, and is in the state where a so-called D cut is performed on the some parts. It should be noted that, a cover for holding the transmission mechanism 65 is attached to the housing 62 after the transmission mechanism 65 is attached. However, the description thereof is omitted in the figure. In the case where the cover is attached thereto, abrasion of the gear 652 caused by friction between the cover and the gear 652 may occur. In order to avoid it, in the present exemplary embodiment, a configuration is adopted in which the bearing 656 is arranged between the cover and the gear 652 and thus the gear 652 is not directly in contact with the cover.

Figure 13A:
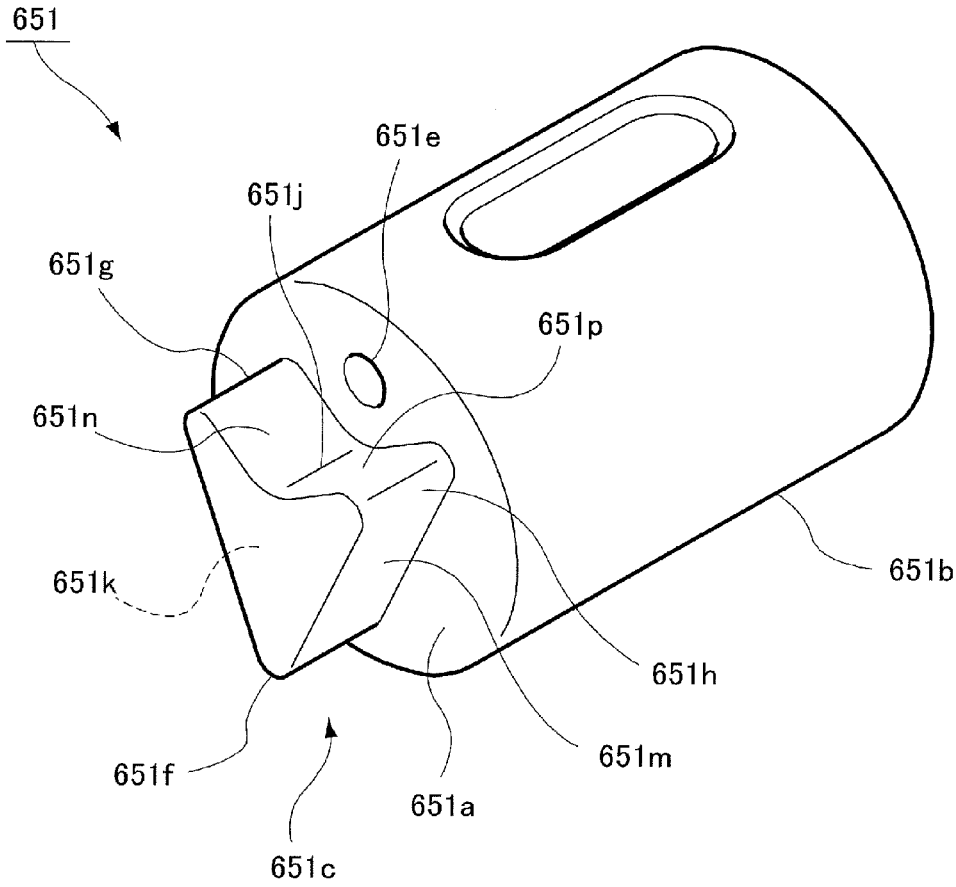
FIGS. 13A and 13B are views for explaining the transmission side coupling member.
Figure 13B:
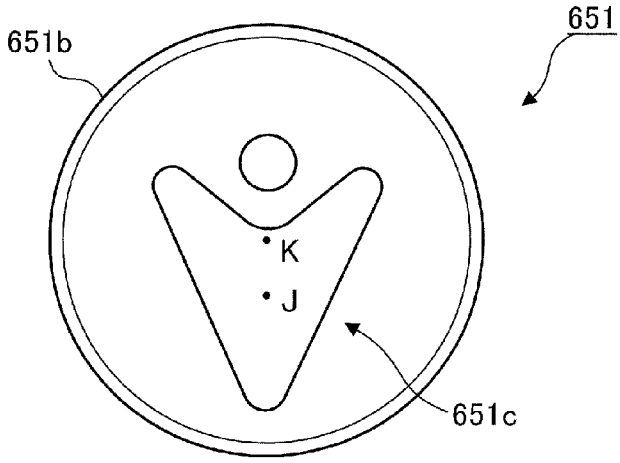

Here, FIGS. 13A and 13B are views for explaining the transmission side coupling member 651.

It should be noted that FIG. 13A shows a perspective view of the transmission side coupling member 651 and FIG. 13B shows a top view of the transmission side coupling member 651.

As described above and with reference to FIG. 13A, the transmission side coupling member 651 according to the present exemplary embodiment has the cylindrical base portion 651*b* and the engagement portion 651*c*. In addition, the base portion 651*b* is provided with the penetration-hole portion 651*e* that penetrates the end face 651*a* in the axial direction.

As shown in FIG. 13A, the engagement portion 651*c* is provided in a state where the engagement portion 651*c* projects from the end face 651*a* of the base portion 651*b*. Further, the engagement portion 651*c* is formed so that a cross section thereof in the direction orthogonal to the axial direction is in an arrowhead shape (arrow shape). As an additional note, the cross section of the engagement portion 651*c* is formed into a shape like an isosceles triangle. Furthermore, as shown in FIG. 13B, the engagement portion 651*c* is arranged in a state where a center (refer to J in FIG. 13B) of the engagement portion 651*c* in the cross section does not match a rotation center (rotation axis) (refer to K in FIG. 13B) of the base portion 651*b*. That is, the engagement portion 651*c* is eccentrically arranged with respect to the base portion 651*b*.

Moreover, as shown in FIG. 13A, the engagement portion 651*c* formed into the arrowhead shape has a tip portion 651*f* that is arranged so as to point to an outer circumference of the base portion 651*b*, and a first peak portion 651*g* and a second peak portion 651*h* that are arranged more closely to the center of the axis than the tip portion 651*f*. Further, the engagement portion 651*c* has a bottom portion 651*j* that is located between the first peak portion 651*g* and the second peak portion 651*h* and that is a curved portion connecting the first peak portion 651*g* and the second peak portion 651*h*, which is curved toward the tip portion 651*f*. Furthermore, the engagement portion 651*c* is provided with a first flat face 651*k* formed by connecting the tip portion 651*f* and the first peak portion 651*g*, a second flat face 651*m* formed by connecting the tip portion 651*f* and the second peak portion 651*h*, a third flat face 651*n* formed by connecting the first peak portion 651*g* and the bottom portion 651*j*, and a fourth flat face 651*p* formed by connecting the second peak portion 651*h* and the bottom portion 651*j*.

Meanwhile, the penetration-hole portion 651*e* is disposed in the end face 651*a* of the base portion 651*b*, as described above. The penetration-hole portion 651*e* is disposed so as to penetrate the end face 651*a* along the axial direction of the base portion 651*b*, and the penetration-hole portion 651*e* permits air flow between the inside and the outside of the base portion 651*b*. More specifically, when the transmission side coupling member 651 slides toward the gear 652 from the state shown in FIG. 10, air between the shaft 653 and the base portion 651*b* is exhausted to the outside of the base portion 651*b*.

It should be noted that, in the above description, a configuration in which air is exhausted to the outside through the penetration-hole portion 651*e*. However, air may be exhausted by a following configuration, for example.

Figure 14A:
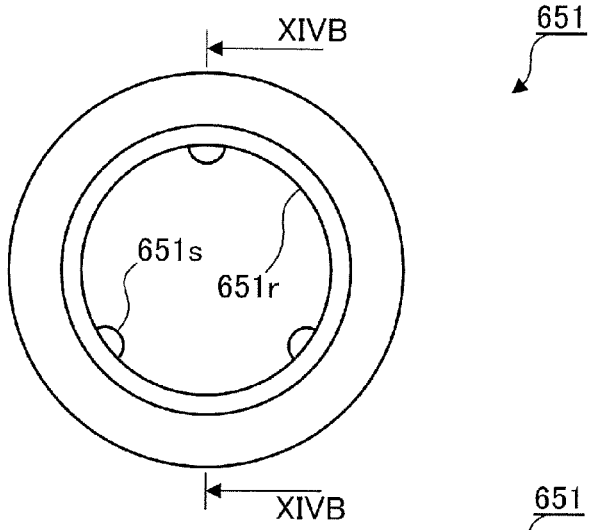
FIGS. 14A to 14C show other configuration examples of the transmission side coupling member.
Figure 14B:
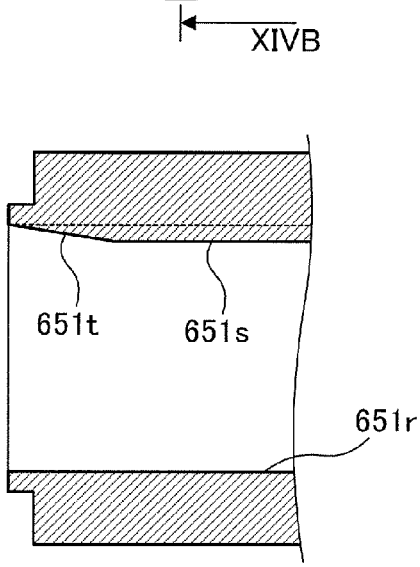
Figure 14C:
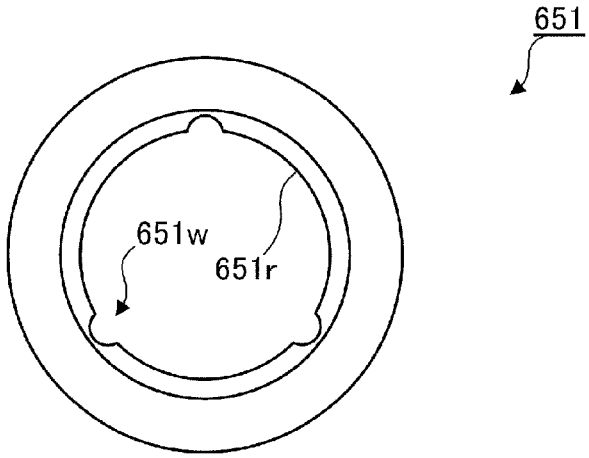

Here, FIGS. 14A to 14C show other configuration examples of the transmission side coupling member 651. For example, as shown in FIGS. 14A and 14B, in the transmission side coupling member 651, raised portions 651*s* formed along the axial direction may be provided on the inner circumferential face 651*r*. A cross section of the raised portions 651*s* is in, for example, a half circle shape. It should be noted that, the FIG. 14B shows a cross section taken along a line XIVB-XIVB in the FIG. 14A. In this configuration example, air is exhausted through a vacancy formed between the shaft 653 and the inner circumferential face 651*r*. It should be noted that three raised portions 651*s* are provided along the circumferential direction at regular intervals in this configuration example, but more than three raised portions 651*s* may be provided. In addition, as shown in FIG. 14B, at an end portion of each of the raised portions 651*s* closer to the insertion opening, it is preferable that a tapered portion 651*t* whose height is gradually decreased toward the insertion opening is provided. Alternatively, as shown in FIG. 14C, on the inner circumferential face 651*r*, groove portions 651*w* formed along the axial direction may be provided. The cross section of the groove portions 651W is in, for example, a half circle shape. In this configuration example, air is exhausted through the groove portions 651*w*.

Figure 15A:
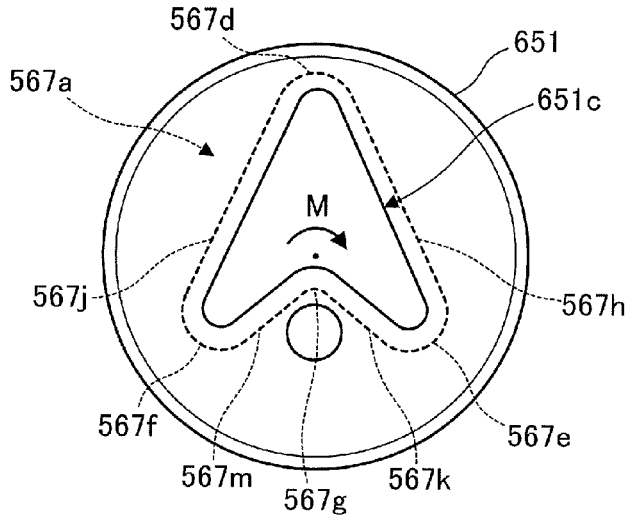
FIGS. 15A to 15C show relationships between the transmission side coupling member and the cam side coupling member.
Figure 15B:
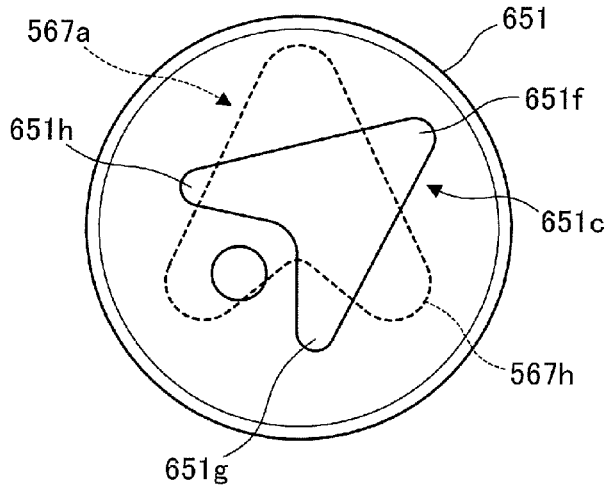
Figure 15C:
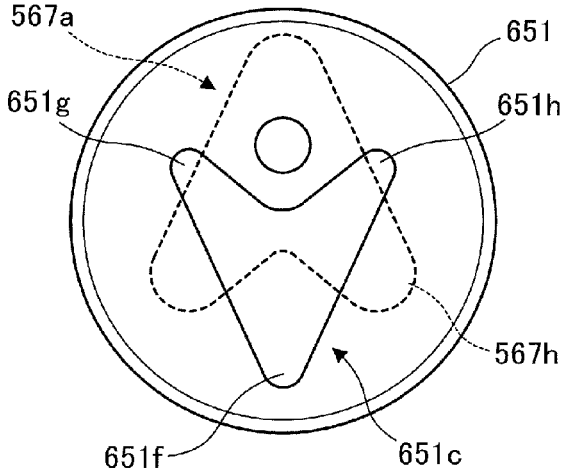

Here, FIGS. 15A to 15C show relationships between the transmission side coupling member 651 and the cam side coupling member 567. It should be noted that, in these figures, while a configuration of the transmission side coupling member 651 is shown on the rear side on the paper, a configuration of the cam side coupling member 567 is shown on the front side on the paper.

Here, a description will be given of the cam side coupling member 567 with reference to FIG. 15A. The cam side coupling member 567 of the present exemplary embodiment is provided with an engagement portion 567*a* (illustrated with a broken line) similarly to the transmission side coupling member 651. However, the engagement portion 567*a* is different from that of the transmission side coupling member 651, and the engagement portion 567*a* does not project from the base portion 567*b*, and is formed so as to be concaved from the end face 567*c* of the base portion 567*b*, as shown in FIG. 9. Here, the engagement portion 567*a* of the present exemplary embodiment functions as a receiving port that receives the engagement portion 651*c* as an example of a projection.

The engagement portion 567*a* is also arranged in a state where a center of the engagement portion 567*a* in the cross section does not match the rotation center (rotation axis) of the base portion 567*b*. That is, the engagement portion 567*a* is eccentrically arranged with respect to the base portion 567*b*. It should be noted that the base portion 567*b* of the present exemplary embodiment is arranged so that the rotation center thereof matches the rotation center of the base portion 651*b*. In addition, the engagement portion 567*a* has an outer shape corresponding to an outer shape of the engagement portion 651*c* of the transmission side coupling member 651. Specifically, it is formed into an arrowhead shape (arrow shape). As an additional note, the engagement portion 567*a* has a cross-sectional shape fitting a cross-sectional shape of the engagement portion 651*c* of the transmission side coupling member 651.

Thus, the engagement portion 567*a* of the cam side coupling member 567 is also provided with a tip portion 567*d*, a first peak portion 567*e*, a second peak portion 567*f* and a bottom portion 567*g*. In addition, the engagement portion 567*a* is provided with a first flat face 567*h*, a second flat face 567*j*, a third flat face 567*k* and a fourth flat face 567*m*. It should be noted that the engagement portion 567*a* of the cam side coupling member 567 is formed so as to be one size larger than the size of the engagement portion 651*c* of the transmission side coupling member 651. Therefore, even if the center of the axis of the cam side coupling member 567 does not match the center of the axis of the transmission side coupling member 651, both of them may be coupled with each other.

Here, as described above, both the engagement portion 651*c* of the transmission side coupling member 651 and the engagement portion 567*a* of the cam side coupling member 567 are eccentrically provided with respect to the respective base portions 651*b* and 567*b*. By this configuration, both the transmission side coupling member 651 and the cam side coupling member 567 become in a state where phases of them become equal only at one point set in advance in the circumferential direction so as to be engaged with each other. As an additional note, when a rotation angle of the cam side coupling member 567 with respect to the transmission side coupling member 651 is an angle set in advance, the engagement portion 567*a* is allowed to receive the engagement portion 651*c*. As a further additional note, when the transmission side coupling member 651 and the cam side coupling member 567 are in the phase state set in advance, the engagement portion 567*a* is allowed to receive the engagement portion 651*c* and they are coupled with each other. Here, the engagement portions 651*c* and 567*a* are each eccentrically and singularly provided. Therefore, the angle set in advance has been set in not plural states but one state. It should be noted that, when the rotation angle of the cam side coupling member 567 with respect to the transmission side coupling member 651 is not the angle set in advance, the engagement portion 567*a* is prevented from receiving the engagement portion 651*c*, as described later.

When the transmission side coupling member 651 rotates as shown in, for example, an arrow M of FIG. 15A from this state, the first flat face 651*k*, the second flat face 651*m* and the third flat face 651*n* (refer to FIG. 13A) of the engagement portion 651*c* press the first flat face 567*h*, the second flat face 567*j* and the third flat face 567*k* of the engagement portion 567*a*, respectively. That is, the transmission side coupling member 651 is to press the cam side coupling member 567 at three contact portions. In this case, a load from the transmission side coupling member 651, which is imposed on the cam side coupling member 567, is not concentrated at one point, but is to be dispersed.

When the transmission side coupling member 651 rotates in the reverse direction, the first flat face 651*k*, the second flat face 651*m* and the fourth flat face 651*p* of the engagement portion 651*c* press the first flat face 567*h*, the second flat face 567*j* and the fourth flat face 567*m* of the engagement portion 567*a*, respectively.

As a result, the cam side coupling member 567 rotates in conjunction with the transmission side coupling member 651, and the cam 563 (refer to FIG. 2) also rotates in conjunction with the transmission side coupling member 651. Therefore, in accordance with the rotation of the transmission side coupling member 651, the intermediate transfer belt 51 is brought into contact with the photoconductor drums 31 of the image forming units 30Y, 30M and 30C, or the intermediate transfer belt 51 is separated from the photoconductor drums 31 of the image forming units 30Y, 30M and 30C (refer to FIG. 2).

It should be noted that, when the transmission side coupling member 651 and the cam side coupling member 567 are intended to be coupled with each other in a state where their phases are displaced about 45 degrees as an example, in the circumferential direction, the tip portion 651*f*, the first peak portion 651*g* and the second peak portion 651*h* of the transmission side coupling member 651 hit the end face 567*c* (refer to FIG. 9) of the cam side coupling member 567, as shown in FIG. 15B. As a result, the coupling between the transmission side coupling member 651 and the cam side coupling member 567 is prevented. Further, in this case, the transmission side coupling member 651 is retracted toward the gear 652 against the bias force of the coil spring 655 (refer to FIG. 10). It should be noted that a configuration may be adopted in which the cam side coupling member 567 is retracted.

When the transmission side coupling member 651 and the cam side coupling member 567 are intended to be coupled in a state where their phases are displaced 180 degrees as an example, in the circumferential direction, the tip portion 651*f*, the first peak portion 651*g*, and the second peak portion 651*h* of the transmission side coupling member 651 hit the end face 567*c* of the cam side coupling member 567, as shown in FIG. 15C. As a result, also in this case, the coupling between the transmission side coupling member 651 and the cam side coupling member 567 is prevented.

The belt unit 50 of the present exemplary embodiment is provided so as to be detachably attachable to the apparatus body 1A, as described above. Here, the attachment or detachment of the belt unit 50 is performed in various timing. For example, there is a case when a new belt unit 50 in a full-color mode (the belt unit 50 in a state shown in FIG. 2A) is attached after the power supply is turned off in the state where the second driving unit 60 is in the monochrome mode (the state shown in FIG. 8). There is another case in which the mode is changed to the full-color mode because the upward force by the cam 563 is released at the time of the maintenance or the like, after, in the present exemplary embodiment, the second support portion 562 is pressed upward by the cam 563 to set the belt unit 50 to be in the monochrome mode (the state in FIG. 2B). Then, the belt unit 50 whose mode is changed to the full-color mode may be pressed into the second driving unit 60 set in the monochrome mode.

Meanwhile, as described above, if the transmission side coupling member 651 and the cam side coupling member 567 are coupled with each other in a state where the mode of the second driving unit 60 and the mode of the belt unit 50 are different, it results in a state in which the intermediate transfer belt 51 is in contact with the photoconductor drums 31 of the image forming units 30Y, 30M and 30C, while transmission of the drive force to these photoconductor drums 31 is released.

Further, if the transmission side coupling member 651 and the cam side coupling member 567 are engaged with each other, an originally intended operation becomes difficult. For example, if the transmission side coupling member 651 and the cam side coupling member 567 are engaged with each other in a state where the second driving unit 60 is in the monochrome mode as shown in FIG. 8 and the belt unit 50 is in the full-color mode as shown in FIG. 2A, the originally intended operation becomes difficult. Specifically, if the cam 563 is intended to be rotated by pushing the movable plate 61 in FIG. 8, the cam 563 may not be rotated because the cam 563 hits the second supporting portion 562. Moreover, the sliding of the movable plate 61 in a pulling-out direction from the housing 62 is also difficult because the second rack gear 615 hits the housing 62. Therefore, since the movable plate 61, the cam 563 and the like become in a locked state, the originally intended operation becomes difficult.

On the other hand, in the present exemplary embodiment, if the transmission side coupling member 651 and the cam side coupling member 567 are intended to be engaged with each other in a state where the mode of the second driving unit 60 is different from the mode of the belt unit 50, as already shown in FIGS. 15B and 15C, the tip portion 651*f*, the first peak portion 651*g* and the second peak portion 651*h* of the transmission side coupling member 651 hit the end face 567*c* of the cam side coupling member 567. That is, the coupling between the transmission side coupling member 651 and the cam side coupling member 567 is prevented.

It should be noted that, in this case, in the present exemplary embodiment, for example, an initialized operation is executed in order to rotate the transmission side coupling member 651 by sliding the movable plate 61, and the coupling between the transmission side coupling member 651 and the cam side coupling member 567 is performed. By this operation, the mode of the second driving unit 60 and the mode of the belt unit 50 become in a synchronous state. It should be noted that the coupling between the transmission side coupling member 651 and the cam side coupling member 567 is performed by the controller 68 as an example of a coupling unit, the motor M2 and the like.

It should be noted that an assembly error in an assembling process, or the like may cause the coupling between the transmission side coupling member 651 and the cam side coupling member 567 in a state where the mode of the second driving unit 60 and the mode of the belt unit 50 are different. For example, if the transmission mechanism 65 is attached to the housing 62 in a state where the transmission mechanism 65 is rotated 180 degrees in the circumferential direction from the state shown in FIG. 8, the transmission side coupling member 651 and the cam side coupling member 567 are coupled with each other in a state where these modes are different. Therefore, in the present exemplary embodiment, a reference of each of the components for installation at the time of assembly is formed at a position which is visually checkable by an operator. More specifically, first, the engagement portion 651*c* of the transmission side coupling member 651 is formed in an arrowhead shape (arrow shape), as described above. Moreover, as shown in FIG. 10, a gear-side mark 652*h* is formed in the gear 652. Here, the gear-side mark 652*h* is formed by outwardly protruding a part of the outer circumferential face 652*g* of the concave portion 652*f* formed into a circular shape so as to have a shape like a triangle.

Moreover, as shown in FIG. 10, a plate-side mark 615*a* is formed on a side of the second rack gear 615. The plate-side mark 651*a* is formed into a triangle shape and a concave shape. It should be noted that the plate-side mark 615*a* is arranged so that a peak portion thereof points to a tooth portion of the second rack gear 615.

Then, in the present exemplary embodiment, an operator attaches the movable plate 61 and the transmission mechanism 65 to the housing 62 so that the plate-side mark 615*a* and the tip portion 651*f* of the engagement portion 651*c* are opposed to each other, more specifically, so that the plate side-mark 615*a* is positioned in a direction which the engagement portion 651*c* points to. It should be noted that the attachment may be performed with reference to the gear-side mark 652*h*. That is, the attachment may be performed so that the plate-side mark 615*a* and the gear-side mark 652*h* are opposed to each other.

It should be noted that, in the present exemplary embodiment, a description has been given of an example in which the intermediate transfer belt 51 is brought into contact with or retracted from the photoconductor drums 31 by using the movable plate 61, the transmission mechanism 65 and the like. However, these configurations are only an example, and the configurations of the movable plate 61 and the transmission mechanism 65 may be used for a mechanism for bringing the secondary transfer roll into contact with the intermediate transfer belt or for retracting the secondary transfer roll from the intermediate transfer belt in an image forming apparatus with a so-called four-cycle method, for example. Alternatively, for example, they may be used for a mechanism for bringing the cleaner into contact with the intermediate transfer belt or for retracting the cleaner from the intermediate transfer belt.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming part that includes a plurality of image carriers;

a setting mechanism that sets the image forming part in any one of a first mode in which rotation drive force is transmitted to the plurality of image carriers, and a second mode in which transmission of rotation drive force to any of the plurality of image carriers is stopped;

a belt unit that is detachably provided to an apparatus body, and that includes a belt member arranged in contact with the plurality of image carriers, an arrangement mechanism arranging the belt member in any one of a first arrangement state of being separated from the any of the plurality of image carriers and a second arrangement state of being in contact with the any of the plurality of image carriers, and a receiving member receiving drive force to be used by the arrangement mechanism; and a transmission member that is coupled with the receiving member of the belt unit, and that transmits drive force to the receiving member, coupling of the receiving member and the transmission member being prevented in any one of cases where the image forming part is in the first mode and the belt member is in the first arrangement state, and where the image forming part is in the second mode and the belt member is in the second arrangement state, at the time of mounting the belt unit on the apparatus body.

2. The image forming apparatus according to claim 1, wherein the coupling of the receiving member and the transmission member is allowed in any one of cases where the image forming part is in the first mode and the belt member is in the second arrangement state, and where the image forming part is in the second mode and the belt member is in the first arrangement state, at the time of mounting the belt unit on the apparatus body.

3. The image forming apparatus according to claim 1, further comprising a coupling unit, wherein the receiving member and the transmission member are rotatably arranged and are allowed to be coupled with each other when each being in a phase state set in advance, and the coupling unit couples the transmission member and the receiving member by rotating the transmission member, after the belt unit is mounted on the apparatus body in a state where the coupling is prevented.

4. The image forming apparatus according to claim 1, wherein the rotation drive force is transmitted from a single motor to the plurality of image carriers.

5. The image forming apparatus according to claim 1, wherein drive force used when the setting mechanism sets the image forming part in any one of the first mode and the second mode and the drive force transmitted by the transmission member to the receiving member are supplied from a common drive source.

6. The image forming apparatus according to claim 1, wherein the transmission member is provided so as to be capable of moving in conjunction with the setting mechanism.

7. An image forming apparatus comprising:

a plurality of image carriers that are rotatably provided, and that each carry a toner image;

a plurality of carrier-side receiving members that are provided corresponding to the plurality of image carriers, respectively, and that each receive drive force for a corresponding one of the plurality of image carriers;

a plurality of drive-side transmission members that are provided corresponding to the plurality of image carriers, respectively, that are each coupled with a corresponding one of the plurality of carrier-side receiving members, and that each transmit drive force to a corresponding one of the plurality of carrier-side receiving members;

a release member that releases coupling of any of the plurality of carrier-side receiving members and a corresponding one of the plurality of drive-side transmission members, which correspond to any of the plurality of image carriers;

a belt unit that includes an intermediate transfer belt arranged in contact with the plurality of image carriers and onto which the toner image is transferred, a separation mechanism causing the intermediate transfer belt to be separated from the any of the plurality of image carriers, and a receiving member receiving drive force used by the separation mechanism; and a drive force supplying member that is provided so as to be capable of moving in conjunction with the release member and the receiving member, and that supplies drive force to the release member and the receiving member.

8. The image forming apparatus according to claim 7, wherein the drive force supplying member is provided so as to be capable of moving in conjunction with the receiving member through a coupling member coupled with the receiving member, and coupling of the receiving member and the coupling member is prevented in any one of cases where the coupling is released by the release member and the separation is not performed by the separation mechanism, and where the coupling is not released by the release member and the separation is performed by the separation mechanism, at the time of mounting, on an apparatus body, the belt unit that is detachably provided to the apparatus body.

9. The image forming apparatus according to claim 7, wherein a plurality of the release members are provided, and drive force is provided to each of the plurality of release members, from the drive force supplying member shared by the plurality of release members.

10. The image forming apparatus according to claim 9, wherein the plurality of release members are arranged approximately in parallel in a direction, and the drive force supplying member supplies the drive force to each of the plurality of release members arranged approximately in parallel, by sliding in the direction.

11. The image forming apparatus according to claim 7, wherein the drive force supplying member formed into a plate shape and supplying the drive force by sliding includes a first contact portion on one side surface and a second contact portion on the other side surface, the first contact portion coming in contact with a plurality of the release members, and the second contact portion coming in contact with the receiving member.

12. A method of allowing drive force to be transmitted to a belt unit in an image forming apparatus having an image forming part that includes a plurality of image carriers; a setting mechanism that sets the image forming part in any one of a first mode in which rotation drive force is transmitted to the plurality of image carriers, and a second mode in which transmission of rotation drive force to any of the plurality of image carriers is stopped; the belt unit that is detachably provided to an apparatus body, and that includes a belt member arranged in contact with the plurality of image carriers, an arrangement mechanism arranging the belt member in any one of a first arrangement state of being separated from the any of the plurality of image carriers and a second arrangement state of being in contact with the any of the plurality of image carriers, and a receiving member receiving drive force to be used by the arrangement mechanism; and a transmission member that is coupled with the receiving member of the belt unit, and that transmits drive force to the receiving member, the method of allowing drive force to be transmitted to the belt unit in the image forming apparatus comprising:

allowing coupling of the receiving member and the transmission member in any one of cases where the image forming part is in the first mode and the belt member is in the second arrangement state, and where the image forming part is in the second mode and the belt member is in the first arrangement state, at the time of mounting the belt unit on the apparatus body.

13. The method of allowing drive force to be transmitted to the belt unit in the image forming apparatus according to claim 12, wherein the coupling of the receiving member and the transmission member is prevented in any one of cases where the image forming part is in the first mode and the belt member is in the first arrangement state, and where the image forming part is in the second mode and the belt member is in the second arrangement state, at the time of mounting the belt unit on the apparatus body.

* * * * *